US012173573B2

(12) United States Patent
Liang et al.

(10) Patent No.: US 12,173,573 B2
(45) Date of Patent: Dec. 24, 2024

(54) ADJUSTABLE ELEMENT ENERGY RETENTION MECHANISM

(71) Applicant: Halliburton Energy Services, Inc., Houston, TX (US)

(72) Inventors: Aihua Liang, Carrollton, TX (US); Wesley P. Dietz, Carrollton, TX (US); Alireza Yazdanshenas, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/956,429

(22) Filed: Sep. 29, 2022

(65) Prior Publication Data

US 2023/0107931 A1 Apr. 6, 2023

Related U.S. Application Data

(60) Provisional application No. 63/251,740, filed on Oct. 4, 2021.

(51) Int. Cl.
*E21B 23/01* (2006.01)

(52) U.S. Cl.
CPC ..... *E21B 23/01* (2013.01)

(58) Field of Classification Search
CPC ..... E21B 23/01; E21B 7/061
See application file for complete search history.

(56) References Cited

U.S. PATENT DOCUMENTS 2,021,223 A * 11/1935 Church ..... E21B 33/129 166/208
2,380,612 A * 7/1945 Quintrell ..... E21B 23/01 166/240
2,878,877 A * 3/1959 Baker ..... E21B 33/12955 166/212
3,077,933 A * 2/1963 Bigelow ..... E21B 40/001 166/217
3,131,765 A * 5/1964 Myers ..... E21B 33/1293 166/133
3,237,695 A * 3/1966 Bostock ..... E21B 33/1295 166/134

(Continued)

FOREIGN PATENT DOCUMENTS

WO 2005038193 A1 4/2005

*Primary Examiner* — Steven A MacDonald
(74) *Attorney, Agent, or Firm* — Scott Richardson; Parker Justiss, P.C.

(57) ABSTRACT

Provided, in one aspect, is an anchoring subassembly, a well system, and a method. The anchoring subassembly, in one aspect, includes a mandrel, and an isolation element positioned about the mandrel, the isolation element configured to move between a radially retracted state, a fully radially expanded state, and a relaxed radially expanded state. The anchoring subassembly, in one aspect, further includes a ratch latch body coupled to the isolation element, the ratch latch body configured to hold the isolation element in the fully radially expanded state, and a relief feature coupled to the ratch latch body, the relief feature configured to shear to release stored energy in the isolation element and thereby allow the isolation element to move from the fully radially expanded state to the relaxed radially expanded state.

31 Claims, 28 Drawing Sheets

(56) References Cited

U.S. PATENT DOCUMENTS 3,283,824 A * 11/1966 Hoffman ..... E21B 17/06 166/134
3,420,307 A * 1/1969 Conrad ..... E21B 33/1292 166/134
3,603,388 A * 9/1971 Current ..... E21B 33/1294 166/131
3,746,093 A * 7/1973 Mullins ..... E21B 33/1293 166/134
4,153,109 A 5/1979 Szescila
4,336,841 A * 6/1982 Garner, Jr. ..... E21B 23/01 166/216
4,572,289 A * 2/1986 Rosenthal ..... E21B 23/06 166/123
4,750,559 A * 6/1988 Greenlee ..... E21B 23/01 166/216
5,154,231 A * 10/1992 Bailey ..... E21B 7/061 166/298
5,487,427 A * 1/1996 Curington ..... E21B 33/129 166/387
5,526,884 A * 6/1996 Lembcke ..... E21B 23/01 166/120
5,727,632 A 3/1998 Richards
5,829,531 A * 11/1998 Hebert ..... E21B 23/01 175/81
5,909,770 A * 6/1999 Davis ..... E21B 23/01 175/81
10,920,510 B2 * 2/2021 Egleton ..... E21B 23/04
11,802,454 B2 * 10/2023 Egleton ..... E21B 23/04
2015/0345241 A1 12/2015 Glaser et al.
2017/0058630 A1 * 3/2017 Limb ..... E21B 33/128
2018/0163493 A1 * 6/2018 Le ..... E21B 23/03
2019/0186232 A1 6/2019 Ingram

* cited by examiner

ADJUSTABLE ELEMENT ENERGY RETENTION MECHANISM

CROSS-REFERENCE TO RELATED APPLICATION

This application claims the benefit of U.S. Provisional Application Ser. No. 63/251,740, filed on Oct. 4, 2021, entitled "ADJUSTABLE ELEMENT ENERGY RETENTION MECHANISM," commonly assigned with this application and incorporated herein by reference in its entirety.

BACKGROUND

The unconventional market is very competitive. The market is trending towards longer horizontal wells to increase reservoir contact. Multilateral wells offer an alternative approach to maximize reservoir contact. Multilateral wells include one or more lateral wellbores extending from a main wellbore. A lateral wellbore is a wellbore that is diverted from the main wellbore or another lateral wellbore.

The lateral wellbores are typically formed by positioning one or more deflector assemblies at desired locations in the main wellbore (e.g., an open hole section or cased hole section) with a running tool. The deflector assemblies are often laterally and rotationally fixed within the main wellbore using a wellbore anchor, and then used to create an opening in the casing.

BRIEF DESCRIPTION

Reference is now made to the following descriptions taken in conjunction with the accompanying drawings, in which.

DETAILED DESCRIPTION

Figure 1:
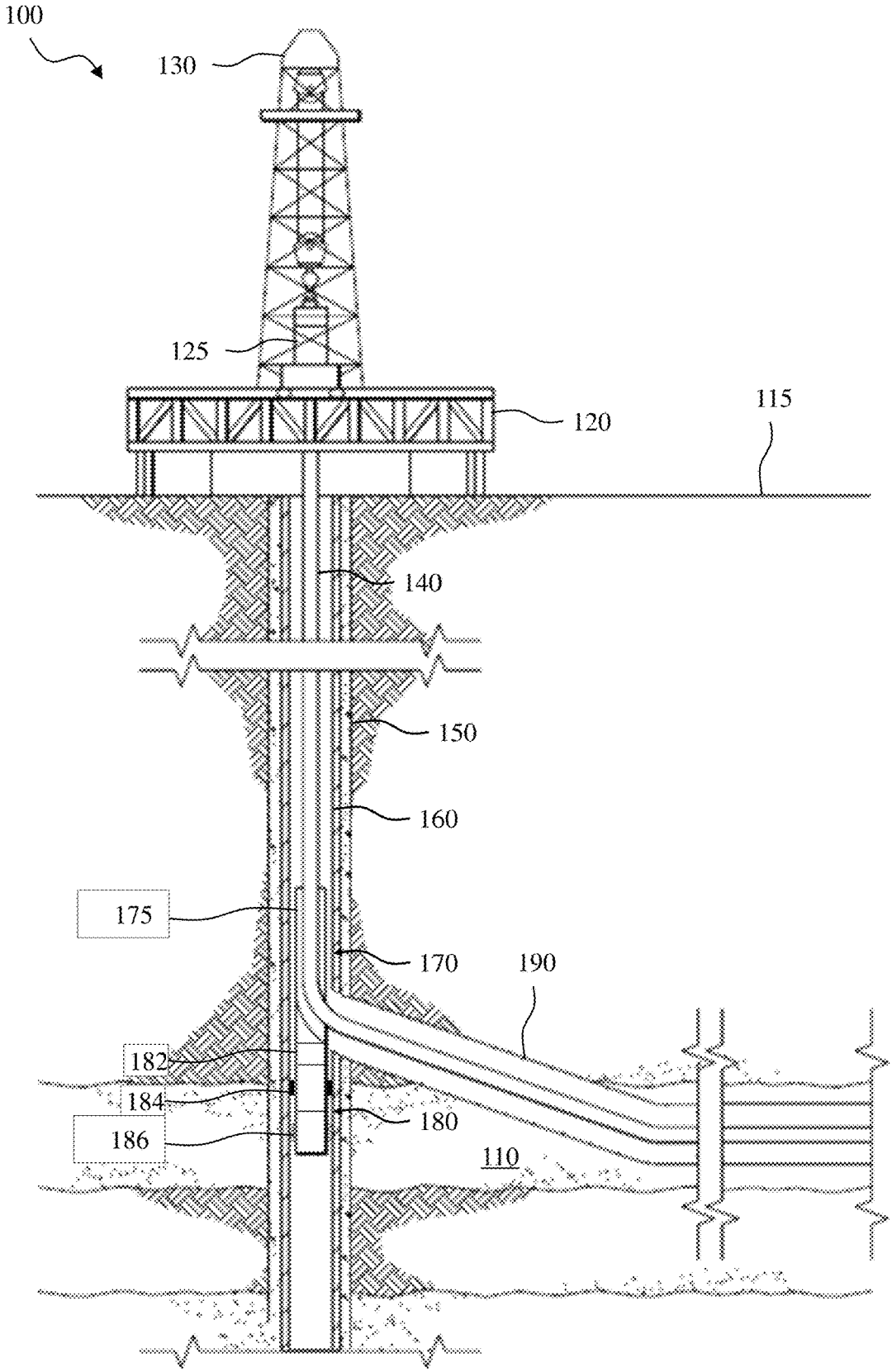
FIG. 1 illustrates a schematic view of a well system designed, manufactured and operated according to one or more embodiments disclosed herein.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms.

Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. Unless otherwise specified, use of the terms "up," "upper," "upward," "uphole," "upstream," or other like terms shall be construed as generally away from the bottom, terminal end of a well; likewise, use of the terms "down," "lower," "downward," "downhole," "downstream," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

The disclosure describes a new method for deploying, setting, and retrieving one or more features of a whipstock assembly, as might be used to form a lateral wellbore from a main wellbore. In at least one embodiment, the whipstock assembly includes an anchoring subassembly, the anchoring subassembly including an orienting receptacle section, a sealing section, and a latching element section. In accordance with one embodiment of the disclosure, the orienting receptacle section, along with a collet and one or more orienting keys, may be used to land and positioned a guided milling assembly within the casing, the guided milling assembly ultimately being used to generate a pocket in the casing. In accordance with one other embodiment of the disclosure, the orienting receptacle section, along with a collet and one or more orienting keys, may be used to land and positioned a whipstock element section of the whipstock assembly within the casing, the whipstock element section ultimately being used to form a lateral wellbore off of the main wellbore, and cement a multilateral junction between the two.

In at least one embodiment, the sealing section may employ any known or hereafter sealing elements capable of setting and/or sealing the sealing section. For example, in at least one embodiment, the sealing elements are polymer sealing elements set with a mechanical axial load. In yet another embodiment the sealing elements are set with a pressure differential, and may or may not comprise a different material than a polymer. Ultimately, unless otherwise required, the present disclosure is not limited to any specific sealing elements.

Notwithstanding the foregoing, in at least one embodiment, the sealing section includes one or more different relief features to deal with excess stored energy in the isolation element of the sealing section. For example, the sealing section can hold the isolation element in its set position (e.g., fully radially expanded state) if the set force and/or setting stroke is proper, but if the set force is too big and/or the isolation element is over set (e.g., there is excess stored energy in the isolation element), the one or more different relief features may allow the isolation element to relax (e.g., self-relax) to a designed value (e.g., to a relaxed radially expanded state) while holding pressure. In at least one embodiment, the one or more different relief features include, without limitation: adding a profile to prevent a retaining screw from prematurely shearing due to the excess stored energy in the isolation element (e.g., created due to the oversetting of the isolation element); adding one or more holding shear features to be self-sheared when excess stored energy exists in the isolation element, the one or more holding shear features relaxing the isolation element to an expected value, while protecting the latch mechanism that holds the features in place; and adding a self-relaxing function that can ensure that the isolation element may be unset by a defined pulling force, thereby preventing swabbing that would occur if the isolation element were pulled out of hole with its isolation element in the expanded state. The inclusion of the relief feature is counterintuitive to existing systems, which attempt to achieve no "backlash." However, the relief feature in the instant application is controlled relief (e.g., by timing and amount), as opposed to that backlash that occurs in the art.

The present disclosure also provides, in at least one other embodiment, a new method for retrieving one or more portions of an anchoring subassembly using a washover assembly. In at least one embodiment, the washover assembly may be used to washover and retrieve an orienting receptacle section of the anchoring sub assembly. In yet another embodiment, the washover assembly may be used to washover and retrieve a sealing section of the anchoring subassembly. In even yet another embodiment, the washover assembly may be used to washover and retrieve a latching element section of the anchoring subassembly. In at least one embodiment, after completing and cementing a multilateral junction (e.g., Level 4 multilateral junction), the resulting transition joint, and one or more portions of the whipstock assembly (e.g., including the whipstock element section, orienting receptacle section, sealing section and/or anchoring section), are milled over and are swallowed by the washover assembly. As the washover assembly mills the sealing section of the anchoring subassembly, any difficulties with the removal of the sealing section, including resulting swabbing effects, are eliminated. Similarly, in one or more embodiments wherein the latching element section may be stuck, the washover assembly may mill the latching element section, eliminating any difficulties with the removal of the latching element section. After the entire whipstock assembly including the whipstock element section and anchoring subassembly are retrieved (e.g., in one trip), the main wellbore may be left with full ID access.

FIG. 1 is a schematic view of a well system 100 designed, manufactured and operated according to one or more embodiments disclosed herein. The well system 100 includes a platform 120 positioned over a subterranean formation 110 located below the earth's surface 115. The platform 120, in at least one embodiment, has a hoisting apparatus 125 and a derrick 130 for raising and lowering one or more downhole tools including pipe strings, such as a drill string 140. Although a land-based oil and gas platform 120 is illustrated in FIG. 1, the scope of this disclosure is not thereby limited, and thus could potentially apply to offshore applications. The teachings of this disclosure may also be applied to other land-based well systems different from that illustrated.

As shown, a main wellbore 150 has been drilled through the various earth strata, including the subterranean formation 110. The term "main" wellbore is used herein to designate a wellbore from which another wellbore is drilled. It is to be noted, however, that a main wellbore 150 does not necessarily extend directly to the earth's surface, but could instead be a branch of yet another wellbore. A casing string 160 may be at least partially cemented within the main wellbore 150. The term "casing" is used herein to designate a tubular string used to line a wellbore. Casing may actually be of the type known to those skilled in the art as a "liner" and may be made of any material, such as steel or composite material and may be segmented or continuous, such as coiled tubing. The term "lateral" wellbore is used herein to designate a wellbore that is drilled outwardly from its intersection with another wellbore, such as a main wellbore. Moreover, a lateral wellbore may have another lateral wellbore drilled outwardly therefrom.

In the embodiment of FIG. 1, a whipstock assembly 170 according to one or more embodiments of the present disclosure is positioned at a location in the main wellbore 150. Specifically, the whipstock assembly 170 could be placed at a location in the main wellbore 150 where it is desirable for a lateral wellbore 190 to exit. Accordingly, the whipstock assembly 170 may be used to support a milling tool used to penetrate a window in the main wellbore 150, and once the window has been milled and a lateral wellbore 190 formed, in some embodiments, the whipstock assembly 170 may be retrieved and returned uphole by a retrieval tool.

The whipstock assembly 170, in at least one embodiment, includes a whipstock element section 175, as well as an anchoring subassembly 180 coupled to a downhole end thereof. The anchoring subassembly 180, in one or more embodiments, includes an orienting receptacle section 182, a sealing section 184, and a latching element section 186 In at least one embodiment, the latching element section 186 axially, and optionally rotationally, fixes the whipstock assembly 170 within the casing string 160. The sealing section 184, in at least one embodiment, seals (e.g., provides a pressure tight seal) an annulus between the whipstock assembly 170 and the casing string 160. The orienting receptacle section 182, in one or more embodiments, along with a collet and one or more orienting keys, may be used to land and positioned a guided milling assembly and/or the whipstock element section 175 within the casing string 160.

The elements of the whipstock assembly 170 may be positioned within the main wellbore 150 in one or more separate steps. For example, in at least one embodiment, the anchoring sub assembly 180, including the orienting receptacle section 182, sealing section 184 and the latching element section 186 are run in hole first, and then set within the casing string 160. Thereafter, the sealing section 184 may be pressure tested. Thereafter, the whipstock element section 175 may be run in hole and coupled to the anchoring subassembly 180, for example using the orienting receptacle section 182. What may result is the whipstock assembly 170 illustrated in FIG. 1.

Figure 2A:
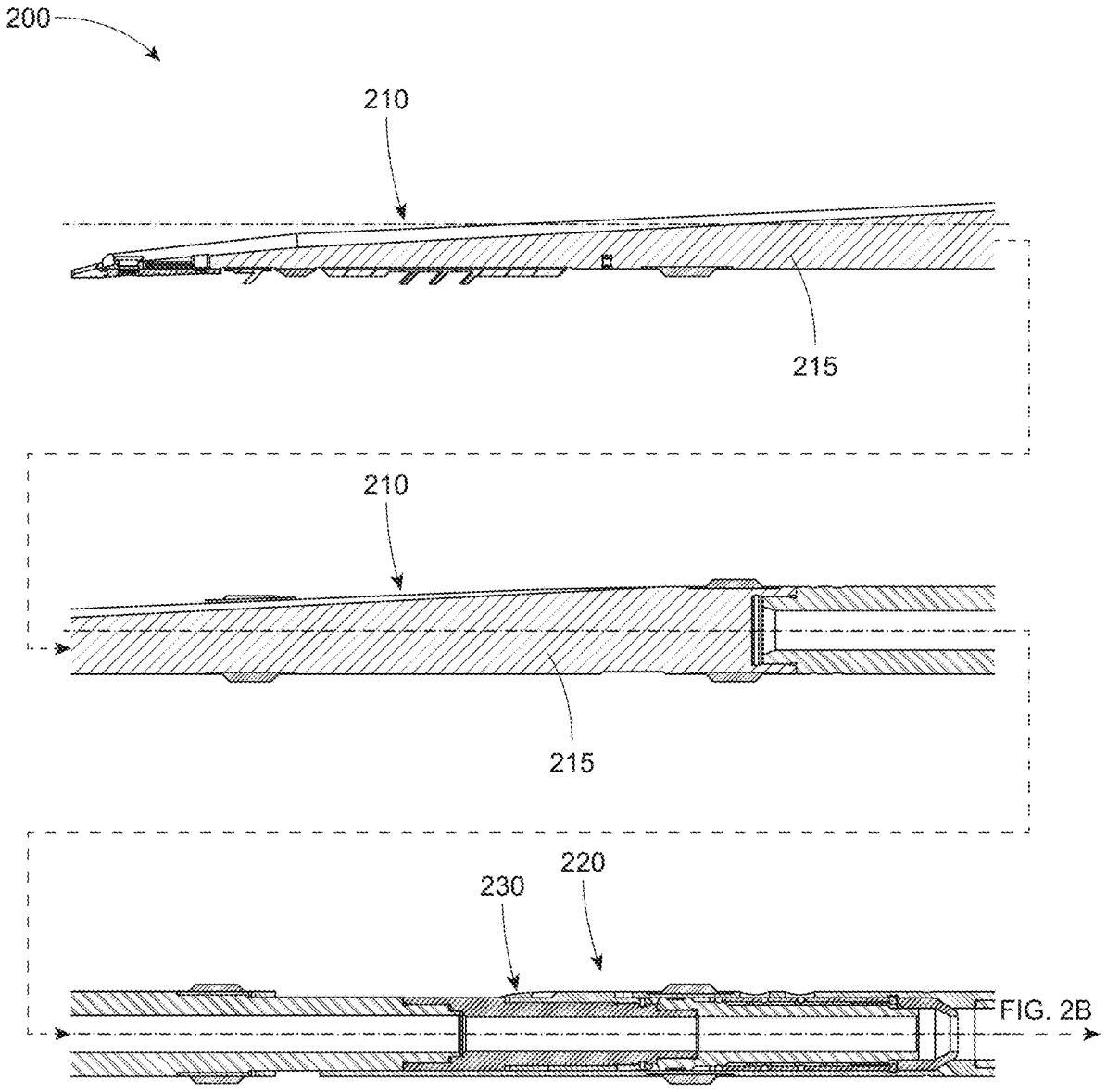
FIGS. 2A and 2B illustrate one embodiment of a whipstock assembly designed and manufactured according to one or more embodiments of the disclosure.
Figure 2B:
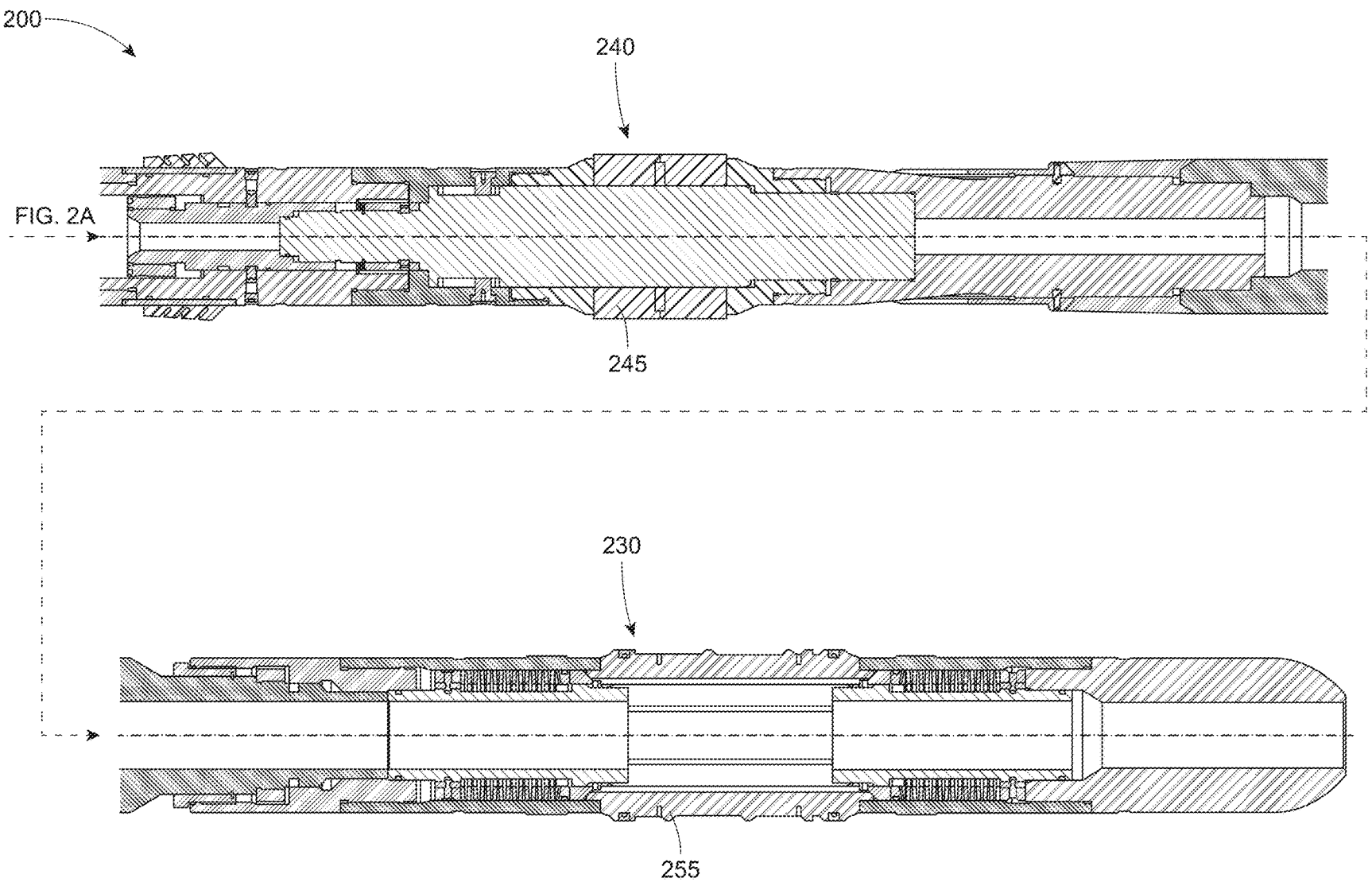

Turning now to FIGS. 2A and 2B, illustrated is one embodiment of a whipstock assembly 200 designed and manufactured according to one or more embodiments of the disclosure. The whipstock assembly 200, in the illustrated embodiment of FIGS. 2A and 2B, includes a whipstock element section 210, and an anchoring subassembly 220. The whipstock element section 210, in the illustrated embodiment, includes a whipstock element section 215 (e.g., ramp element). The anchoring subassembly 220, in one or more embodiments, includes an orienting receptacle section 230 (e.g., including a muleshoe), a sealing section 240, and a latching element section 250. The sealing section 240, in the illustrated embodiment, among other features disclosed below, includes an isolation element 245, the isolation element 245 configured to move between a radially retracted state, a full radially expanded state, and a relaxed radially expanded state. The latching element section 250, in the illustrated embodiment, includes one or more latching features 255, the one or more latching features 255 configured to engage with a profile in a casing string.

Figure 3:
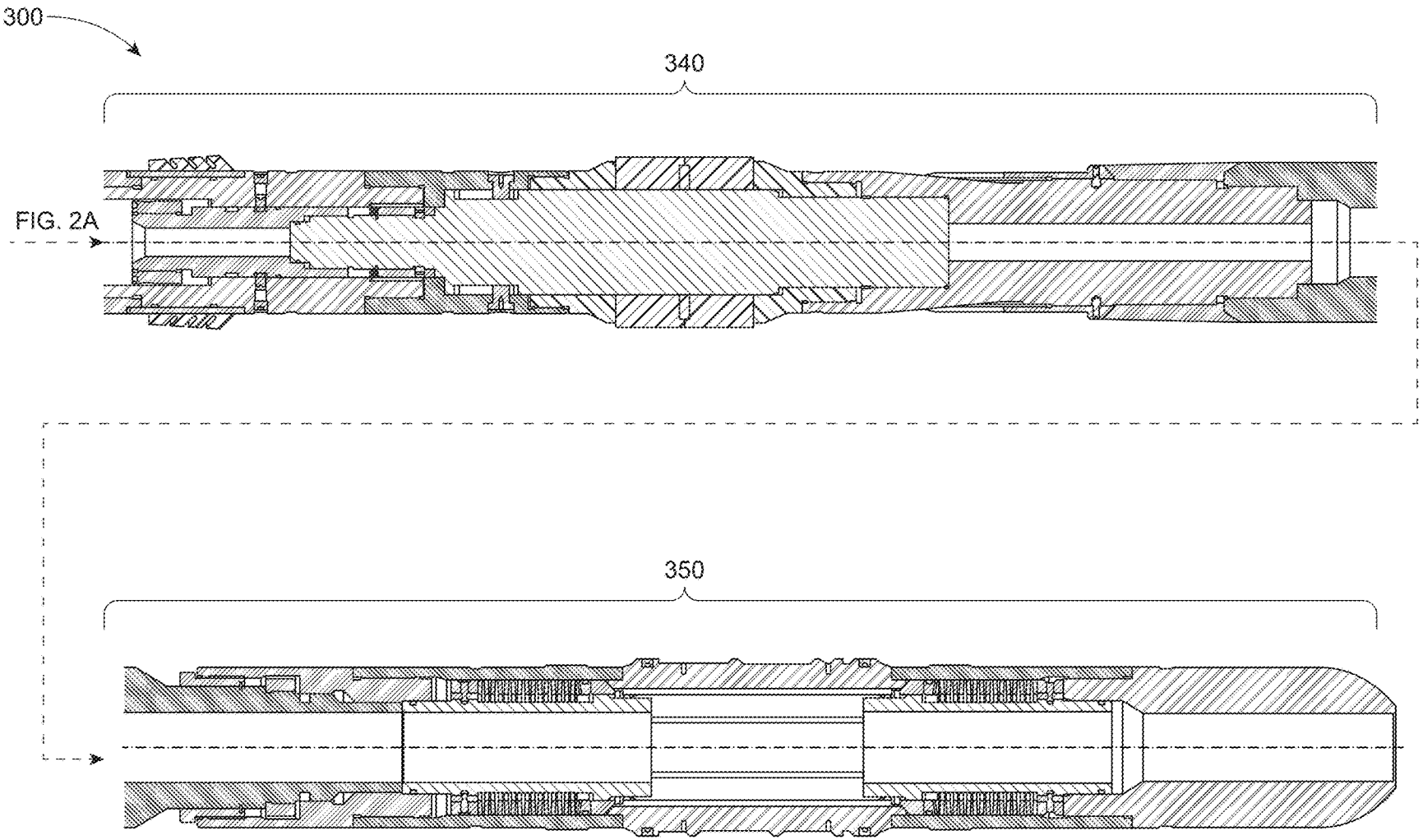
FIG. 3 illustrates an alternative embodiment of an anchoring subassembly, the anchoring subassembly including a sealing section and a latching element section designed and manufactured according to an alternative embodiment of the disclosure.

Turning to FIG. 3, illustrated is an alternative embodiment of an anchoring subassembly 300, the anchoring subassembly including a sealing section 340 and a latching element section 350 designed and manufactured according to an alternative embodiment of the disclosure. The sealing section 340, latching element section 350 and an orienting element section (not shown in FIG. 3) may be run in hole within a main wellbore, set, and then pressure tested, prior to a whipstock element section (not shown in FIG. 3) of the whipstock assembly being run in hole and attached with the sealing section 340 (e.g., engaged with the orienting element section attached to the sealing section 340). Notwithstanding, FIG. 3 illustrates the latching element section 350 in the engaged state, whereas the sealing section 340 is in the radially retracted state.

Figure 4A:
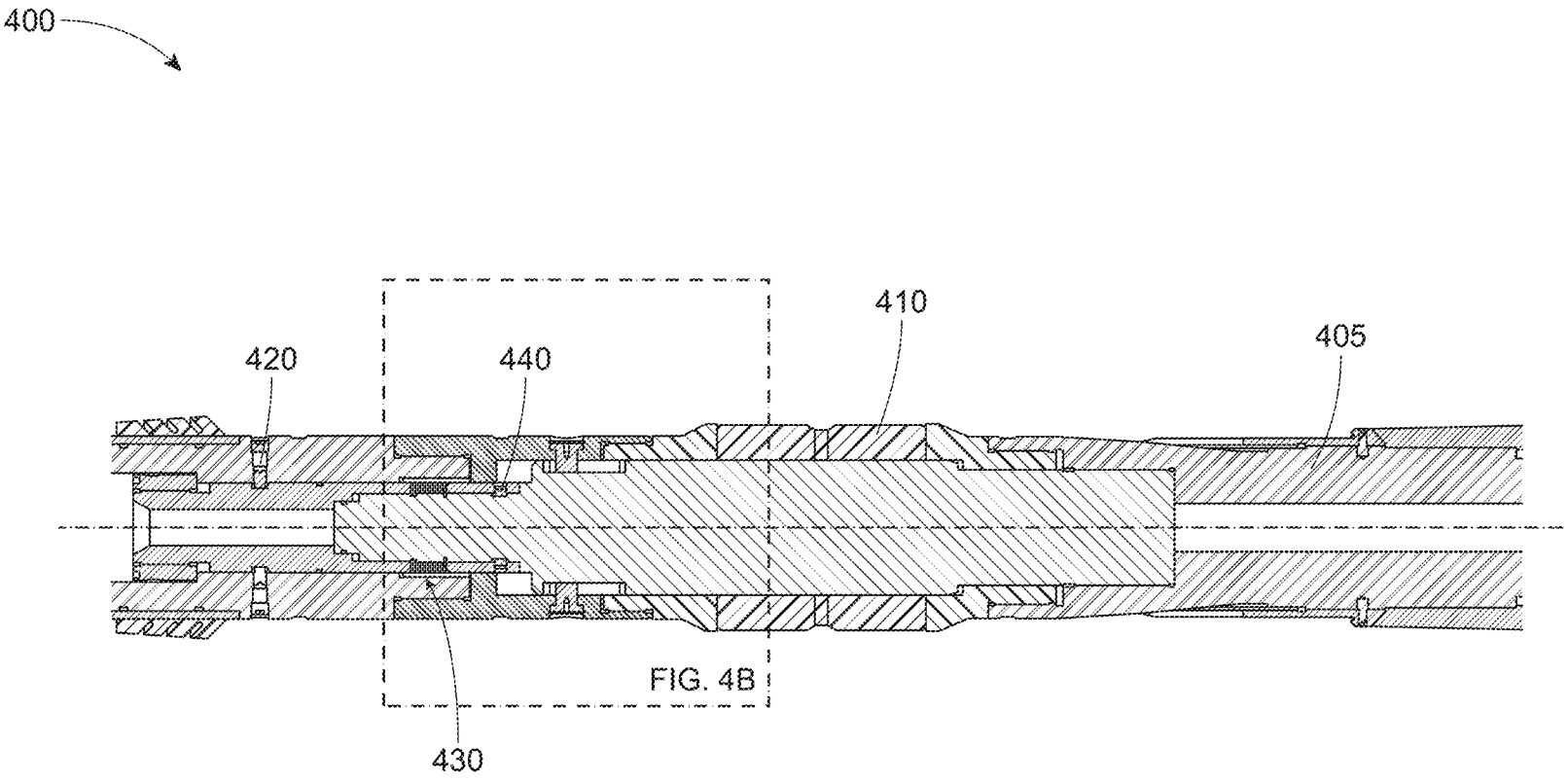
FIGS. 4A and 4B illustrate cross-sectional views of a portion of an anchoring subassembly designed and manufactured according to one or more embodiments of the disclosure.
Figure 4B:
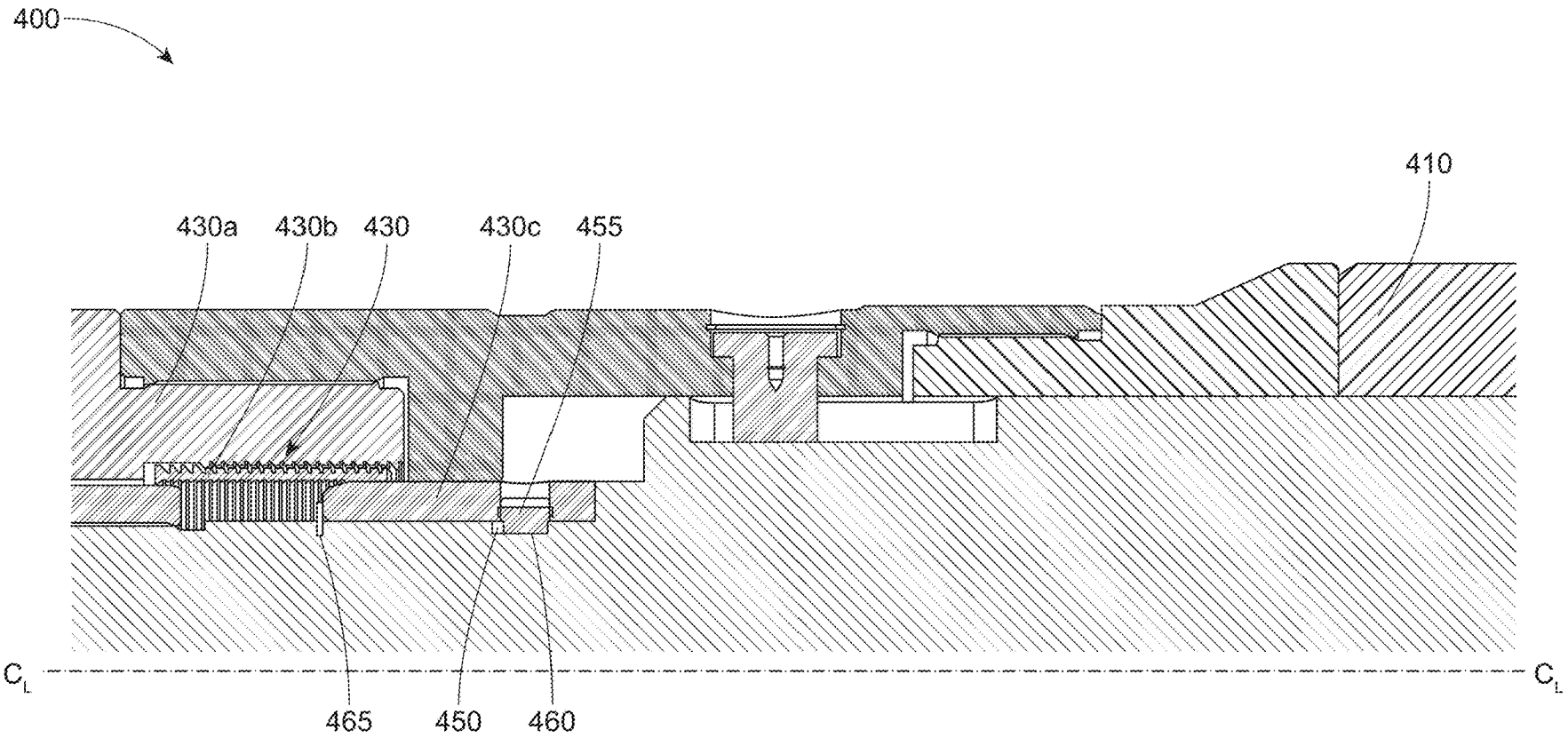

Turning to FIGS. 4A and 4B, illustrated are cross-sectional views of a portion of an anchoring subassembly 400 designed and manufactured according to one or more embodiments of the disclosure. As is illustrated, in one or more embodiments, the anchoring subassembly 400 includes a mandrel 405 having an isolation element 410 positioned thereabout. In at least one embodiment, the isolation element 410 is configured to move between a radially retracted state, a fully radially expanded state, and a relaxed radially expanded state.

The anchoring subassembly 400, in the illustrated embodiment, additionally includes one or more setting shear features 420. In one or more embodiments, the one or more setting shear features 420 are used hold the isolation element 410 in its radially retracted state while running in hole, and thus allowing a flow path for cleaning the wellbore. The anchoring subassembly 400, in one or more embodiments, additionally includes a ratch latch body 430 (e.g., including shear sub 430*a*, body lock ring 430*b*, and slip ring 430*c*) for locking the isolation element 410 at a position while setting. The anchoring subassembly 400, in accordance with one embodiment of the disclosure, additionally includes one or more relief features 440. The one or more relief features 440, in the illustrated embodiment, are configured to shear to release stored energy in the isolation element 410 and thereby allow the isolation element 410 to move from the fully radially expanded state to the relaxed radially expanded state. In at least one embodiment, the one or more relief features 440 are one or more holding shear features, the one or more holding shear features configured to shear when excess stored energy remains within the isolation element 410 after setting.

Figure 5:
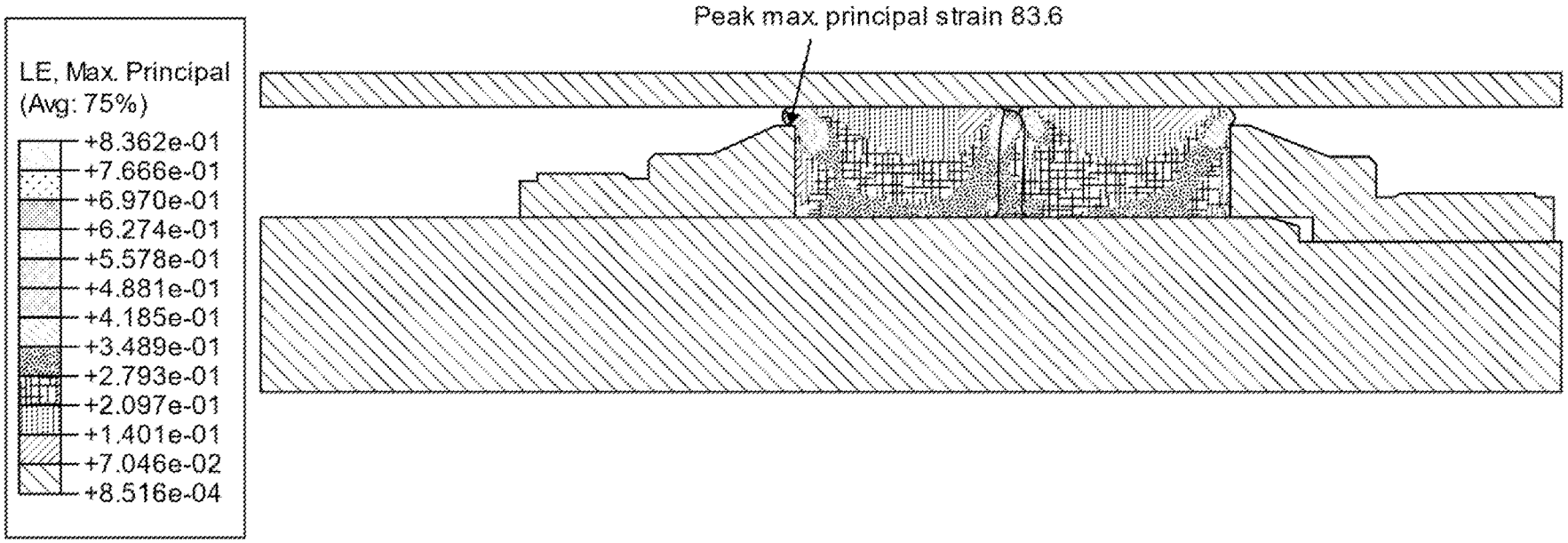
FIGS. 5 through 7 illustrate FEA simulations that may be used to determine a pack-off load.
Figure 6:
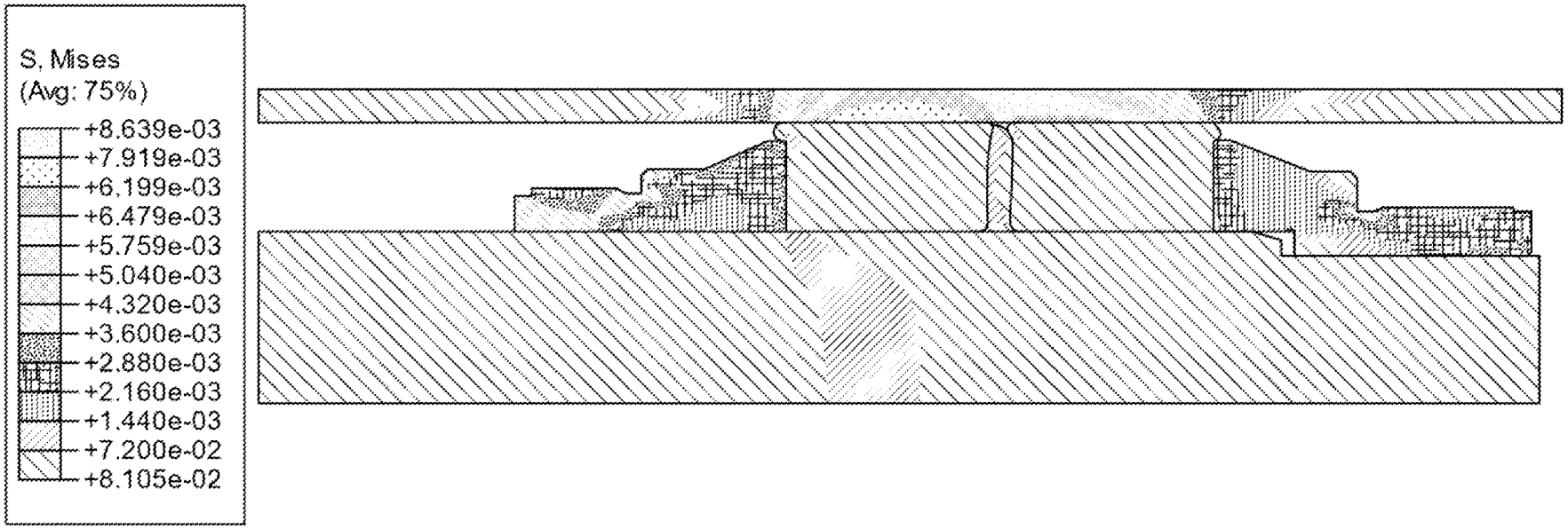
Figure 7:
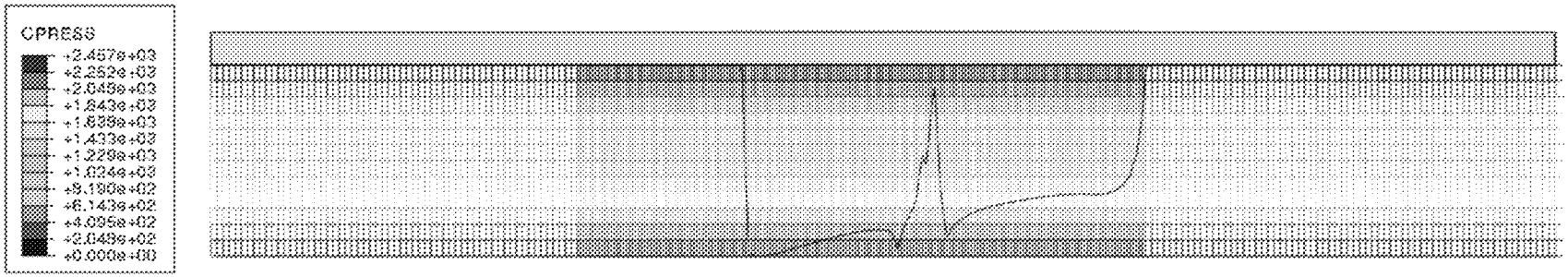

To properly design the one or more relief features 440, FEA simulations of the isolation element 410 is helpful, if not necessary. As shown in FIGS. 5 through 7, the FEA simulations may be used to determine the pack-off load. The pack-off load may be compared with the maximum allowable pulling load to help design the one or more relief features 440 (e.g., a relaxation space in one embodiment). The FEA simulations may also be used to determine what is the proper pulling load for the system, which again can be used to help design the one or more relief features 440 (e.g., a relaxation space in one embodiment). In at least one embodiment, the proper pulling load for the system should be less than the unlatch load needed for the latching feature of the latching element, and the isolation element 410 needs to hold a desired pressure when pushing at the unlatch load.

Figure 8:
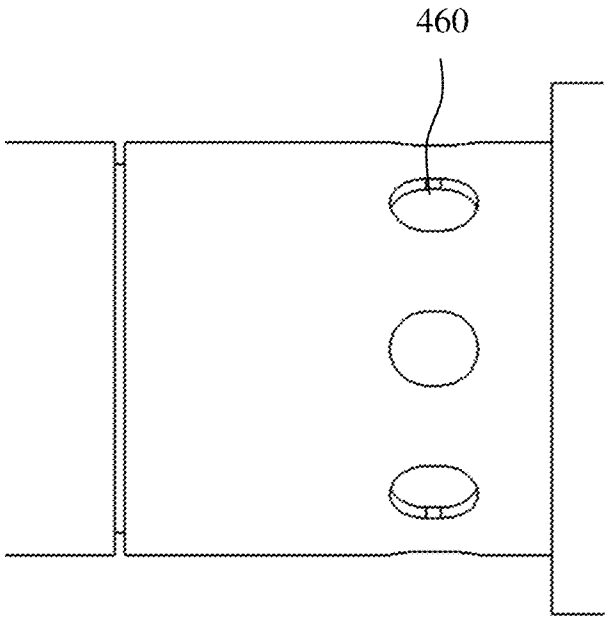
FIG. 8 illustrates one embodiment of an oval profile.

Returning to FIGS. 4A and 4B, based at least in part from what was learned from the FEA simulations, various novel elements were added for relaxing and unsetting the isolation element 410. For example, in at least one embodiment a first relaxation gap 450 was added to allow the isolation element 410 to travel back when needed. In at least one other embodiment, one or more secondary holding shear features 455 were added to hold the isolation element 410 in the set position during milling and other operations. In at least one other embodiment, a profile 460 (e.g., oval profile in one embodiment) was added to the mandrel 405 to allow the one or more secondary holding shear features 455 to create a relaxation space for the one or more secondary holding shear features 455 to travel a predetermined distance (e.g., determined by an FEA analysis or isolation setting test) back when a setting load of the isolation element 410 is higher than needed. (See one embodiment of the profile 460 in FIG. 8). In at least one other embodiment, one or more primary holding shear features 465 (e.g., retaining/shear ring in the illustrated embodiment) were added to retain the isolation element 410 in the fully radially expanded state (e.g., to hold at a set position) if the load is proper. When the load is higher than expected, the one or more primary holding shear features 465 will be sheared, and the one or more secondary holding shear features 455 would travel back in the oval profile 460 to relax the isolation element 410 to the relaxed radially expanded state (e.g., proper setting position). What may result is a second relaxation gap (not shown) on an opposite side of the secondary holding shear feature 455. In the illustrated embodiment, the first relaxation gap 450 is located uphole of the second relaxation gap.

Turning to FIGS. 9A through 12B, illustrated is one embodiment for deploying, setting, relaxing and retrieving an anchoring subassembly 900 designed and manufactured according to one or more embodiments of the disclosure. The anchoring subassembly 900 is similar in many respects to the anchoring subassembly 400 described and illustrated with respect to FIG. 4. Accordingly, like reference numbers have been used to illustrate similar features. The anchoring subassembly 900 includes an isolation element 410, one or more setting shear features 420, a ratch latch body 430 (e.g., including shear sub 430*a*, body lock ring 430*b*, and slip ring 430*c*), a relaxation gap 450, one or more secondary holding shear features 455, a profile 460 providing the relaxation gap 450, and one or more primary holding shear features 465.

Figure 9A:
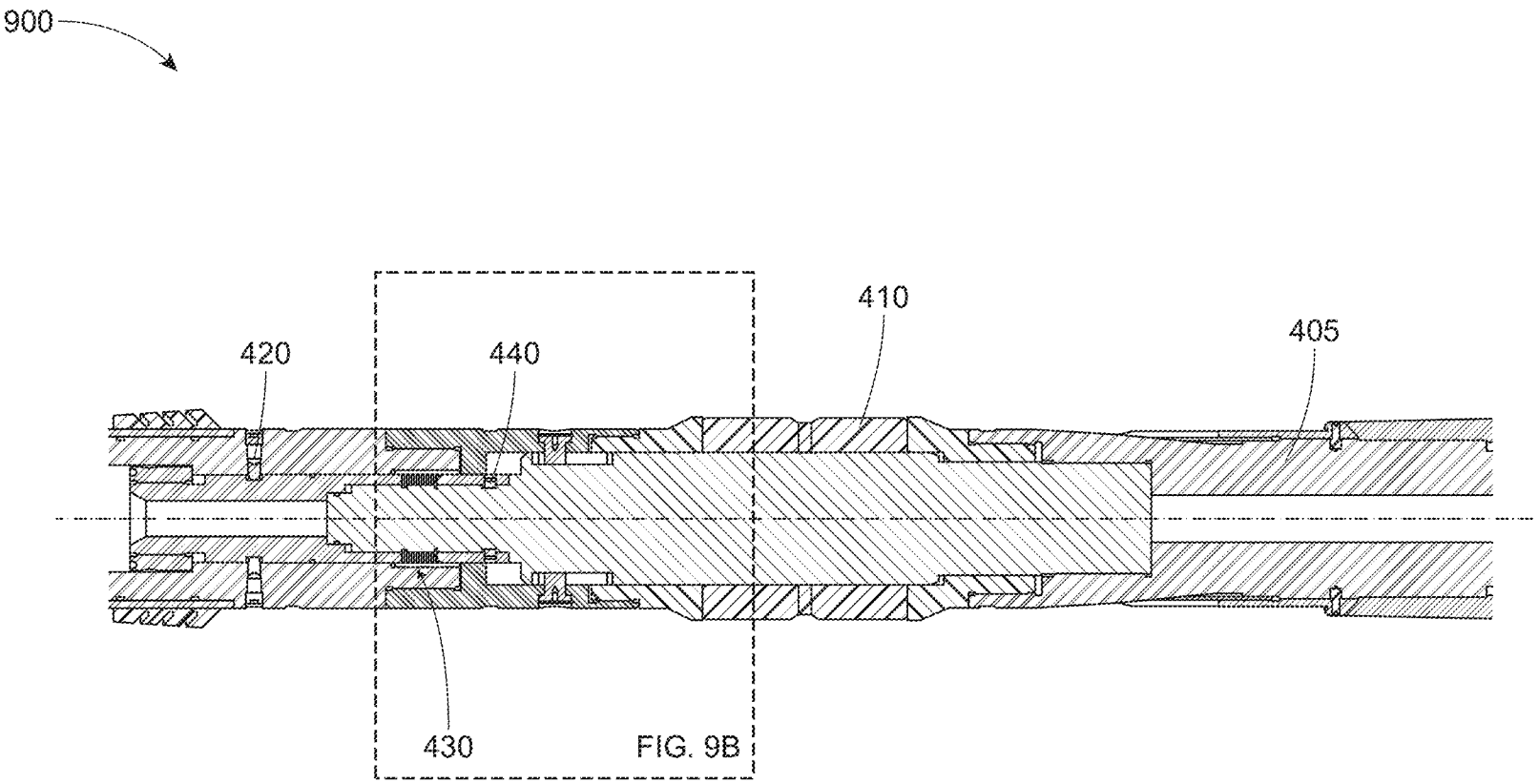
FIGS. 9A through 12B illustrate one embodiment for deploying, setting, relaxing and retrieving an anchoring subassembly designed and manufactured according to one or more embodiments of the disclosure.
Figure 9B:
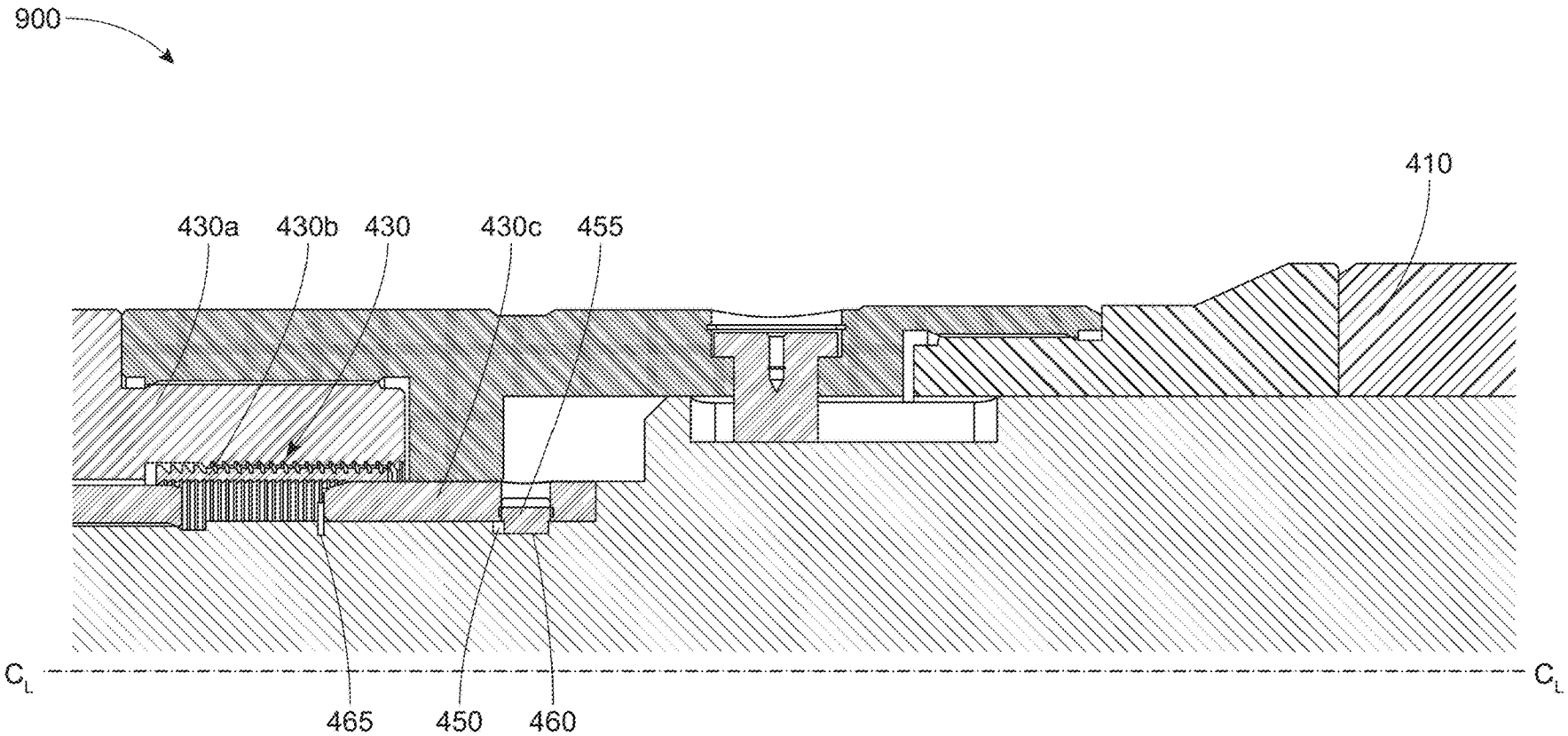
Figure 10A:
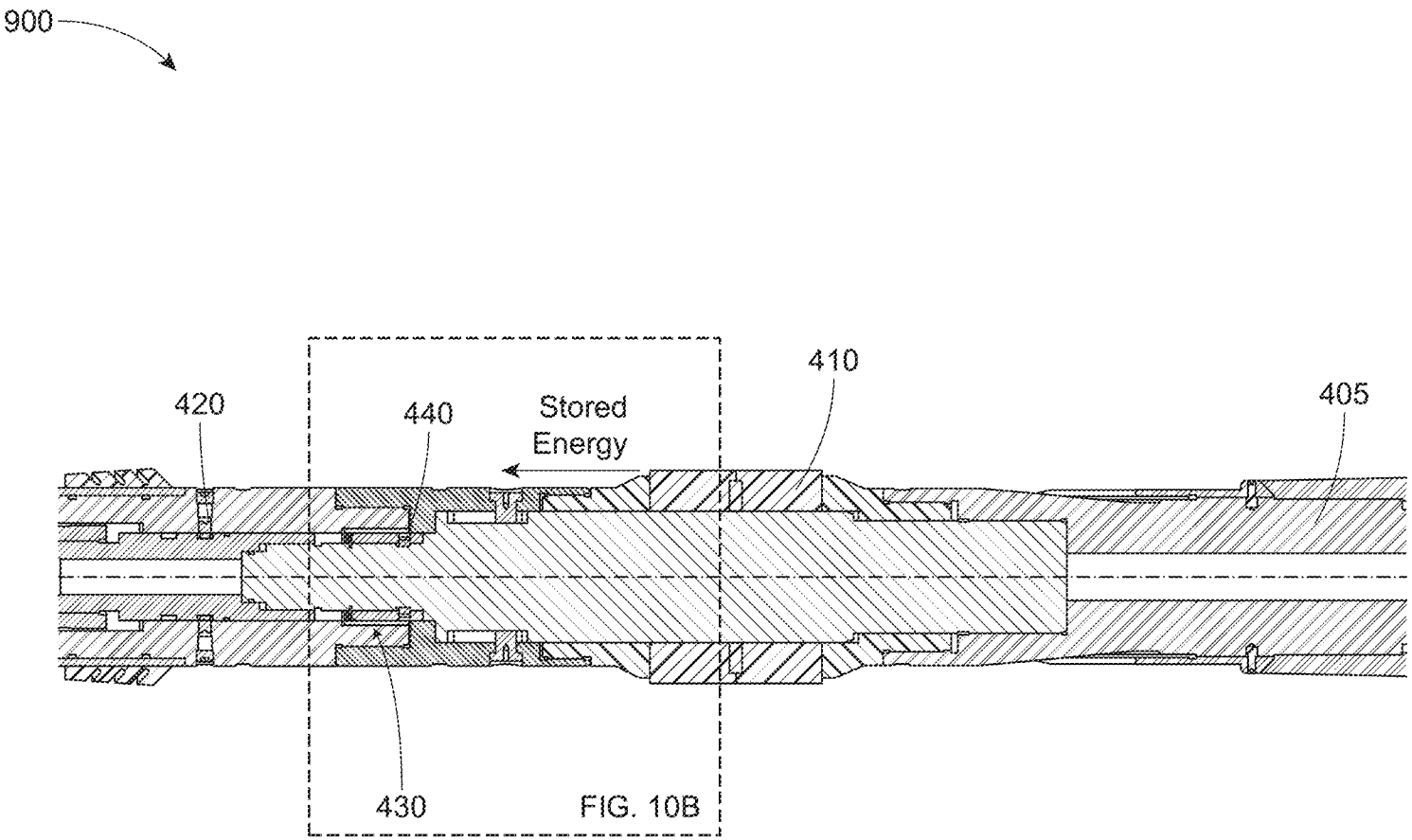
Figure 10B:
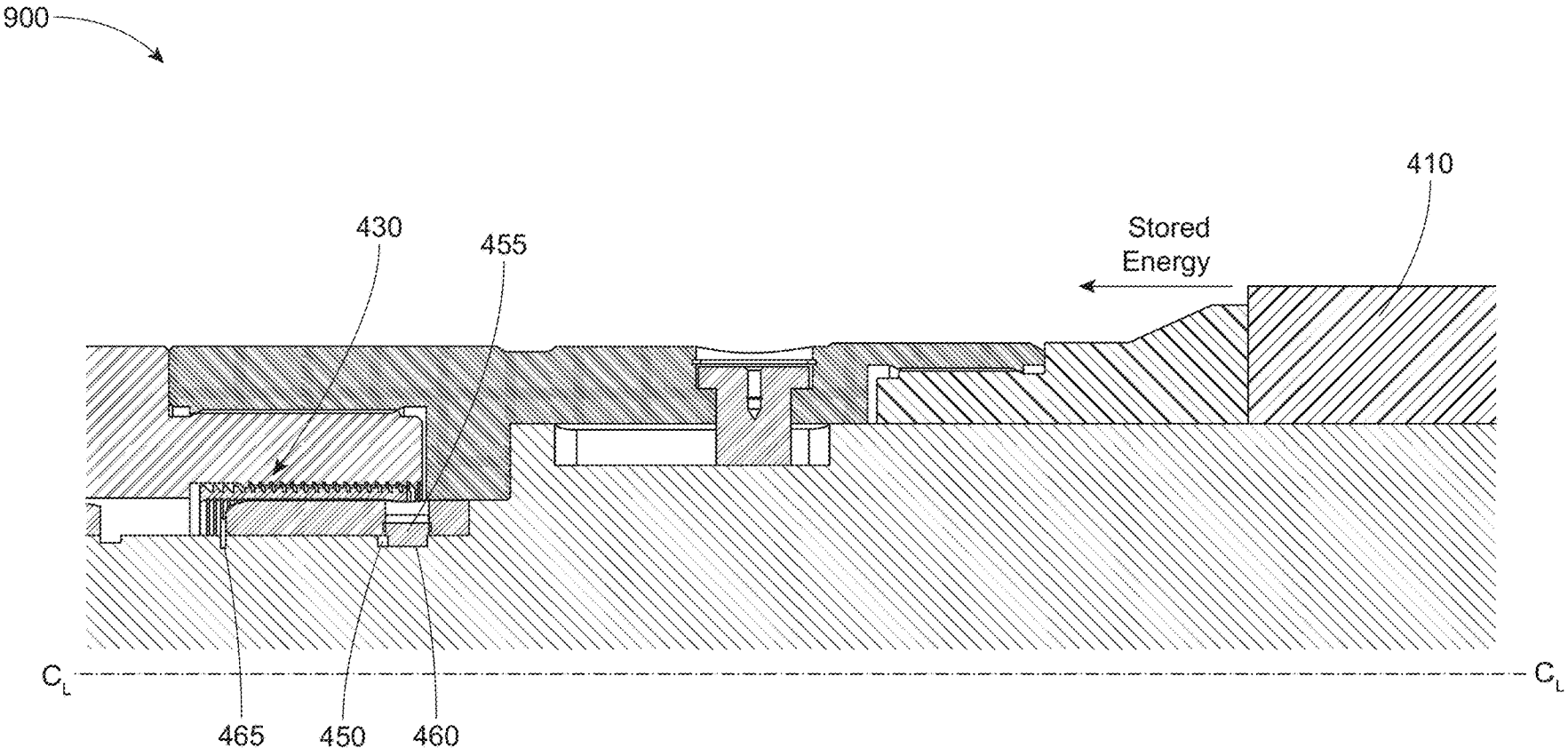

The anchoring subassembly 900 is run in hole, for example in the state shown in FIGS. 9A and 9B. With the anchoring subassembly 900 run in hole to the proper depth, the latching feature of the latching element section (not shown) may be set. With the latching feature set, the anchoring subassembly 900 may be pushed to shear the one or more setting shear features 420, thereby setting the isolation element 410 (e.g., as shown in FIGS. 10A and 10B). In the illustrated embodiment, the one or more primary holding shear features 465 hold the isolation element 410 at the setting position (e.g., fully radially expanded state).

Figure 11A:
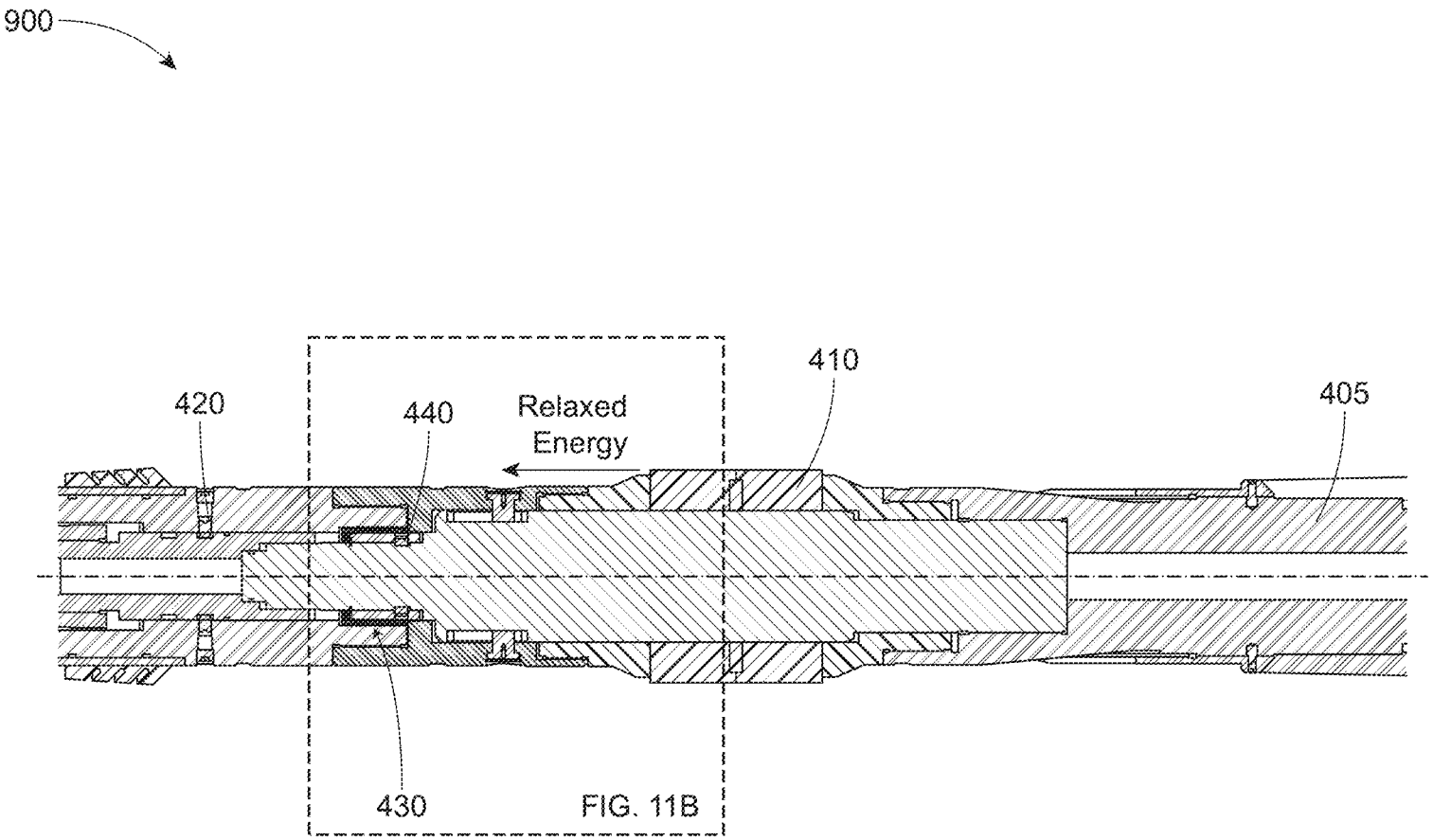
Figure 11B:
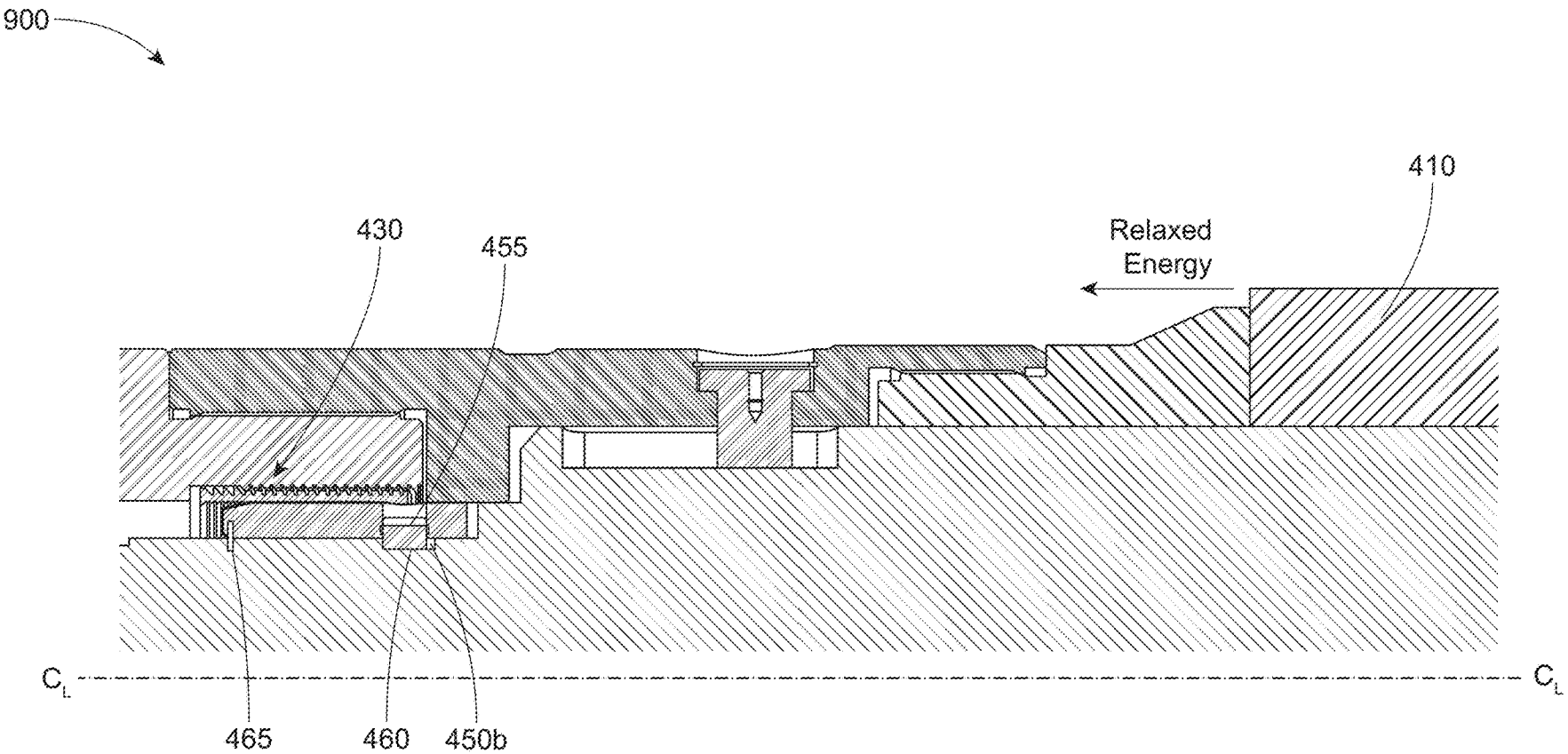

In the case that the stored energy in the isolation element 410 is higher than the shear value of the one or more primary holding shear features 465, the stored energy transmits from the isolation element 410 through the set ratch latch body 430 to the one or more primary holding shear features 465, thereby shearing the one or more primary holding shear features 465. The shearing of the one or more primary holding shear features 465, allows the one or more secondary shear features 455 to close the first relaxation gap 450 in the profile 460, and thereby allow the isolation element 410 to move to the relaxed radially expanded state. For example, as the one or more primary holding shear features 465 shear, the isolation element 410 starts to slide back until the relaxation gap 450 between the one or more secondary holding shear features 455 and internal mandrel closes, thereby relaxing the isolation element 410 to the relaxed radially expanded state (e.g., as shown in FIGS. 11A and 11B). In at least one embodiment, a relaxed gap 450*b* occurs on the opposite side of the secondary shear feature 455 as the original relaxation gap 450 was located. After self-relaxing the isolation element 410, the one or more secondary holding shear features 455 now hold the isolation element 410 in the new (e.g., relaxed) state.

Figure 12A:
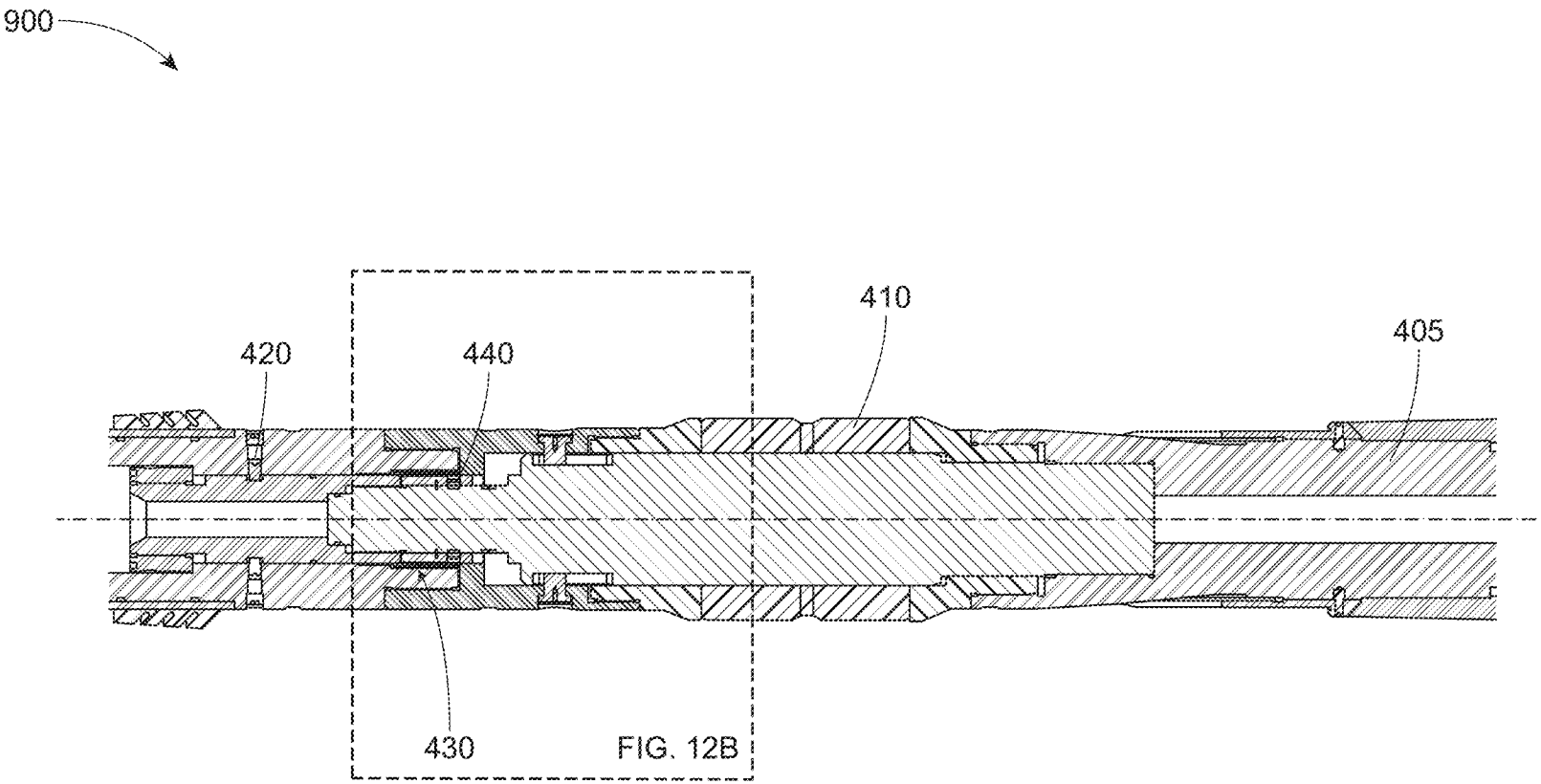
Figure 12B:
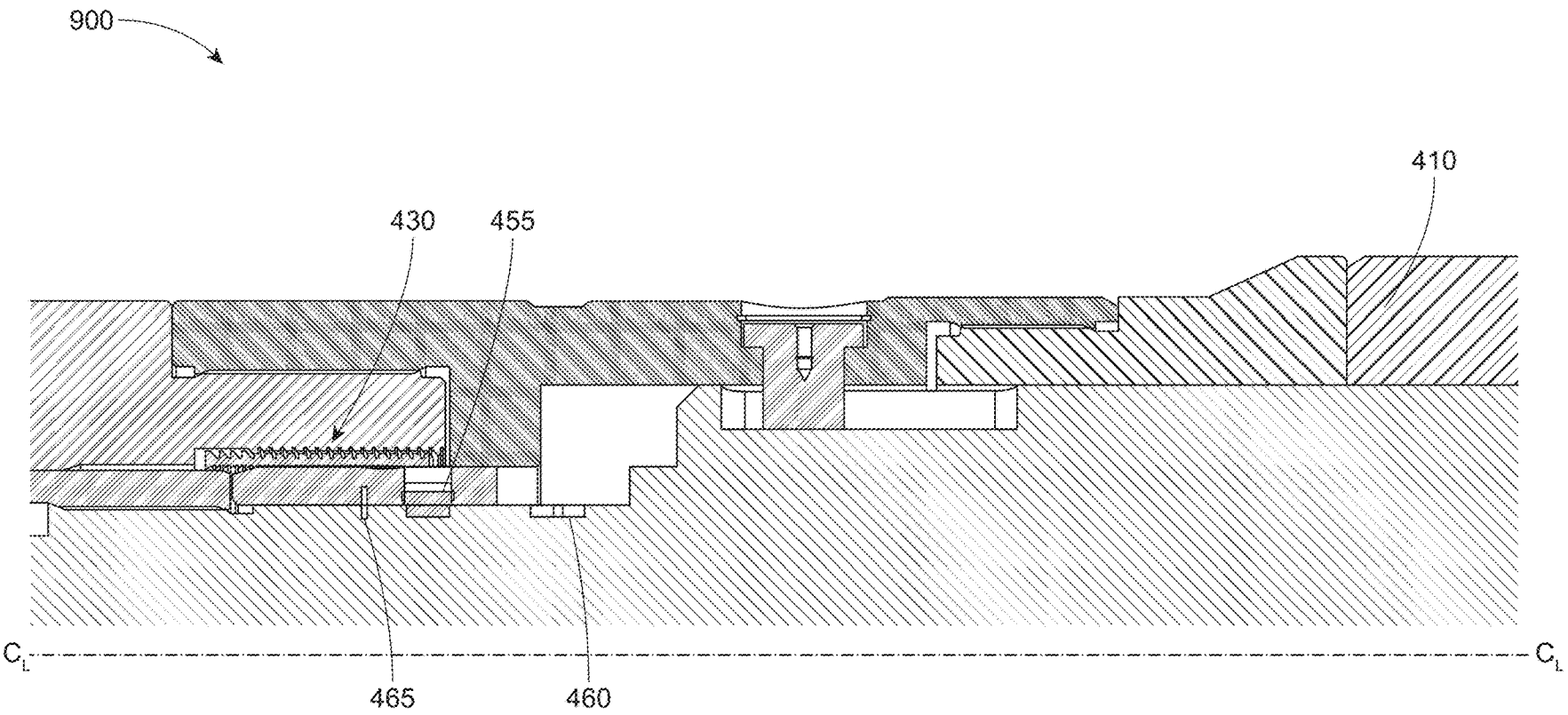

When it is time to unset the isolation element 410, and thus pull the anchoring subassembly 900 uphole, the whipstock assembly may be pulled uphole to shear the one or more secondary holding shear features 455. In doing so, the isolation element 410 returns to its original radially retracted state. At this stage, the anchoring subassembly 900 is ready to be pulled uphole without worrying about swabbing (e.g., as shown in FIGS. 12A and 12B). In certain embodiments, a washover assembly may engulf and remove the anchoring subassembly 900 (e.g., isolation element 410), as opposed to the pulling and shearing of the one or more secondary holding shear features 455.

Note here, the one or more primary holding shear features 465 are designed to have a shear strength equal to or lower than the one or more secondary holding shear features 455, for example to hold the isolation element 410 to a proper setting value, or shear when it is too high. In at least one other embodiment, the one or more primary holding shear features 465 are designed to have a shear strength lower than the one or more secondary holding shear features 455, for example to hold the isolation element 410 to a proper setting value, or shear when it is too high. The profile 460 provides the relaxation gap 450 between the one or more secondary holding shear features 455 and the internal mandrel. In accordance with one or more embodiments, the relaxation gap 450 is defined by FEA simulation values and the stroke difference between fully set to partial set (e.g., expected setting value).

Figure 13A:
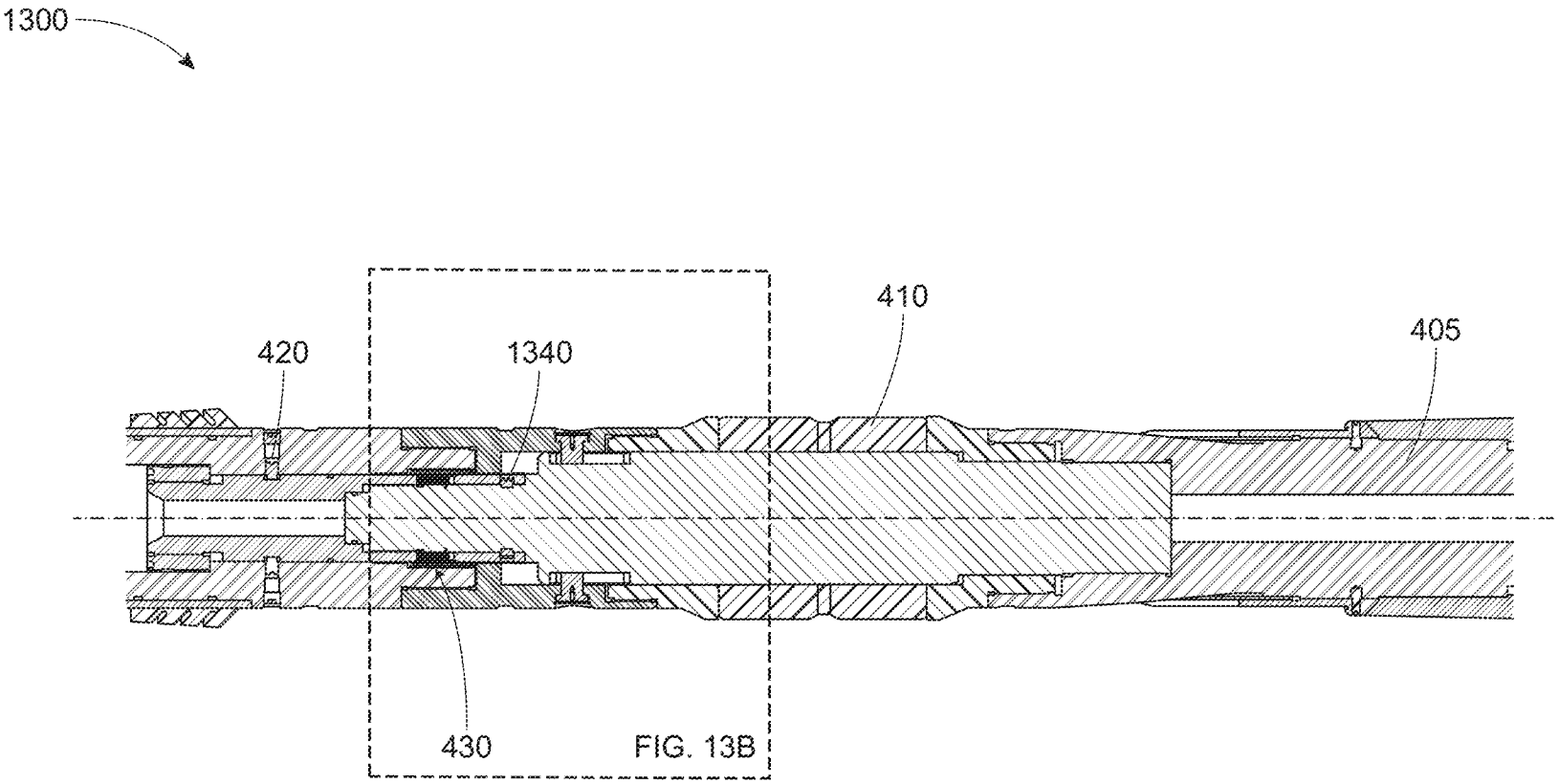
FIGS. 13A and 13B illustrate cross-sectional views of an anchoring subassembly designed, manufactured and operated according to an alternative embodiment of the disclosure.
Figure 13B:
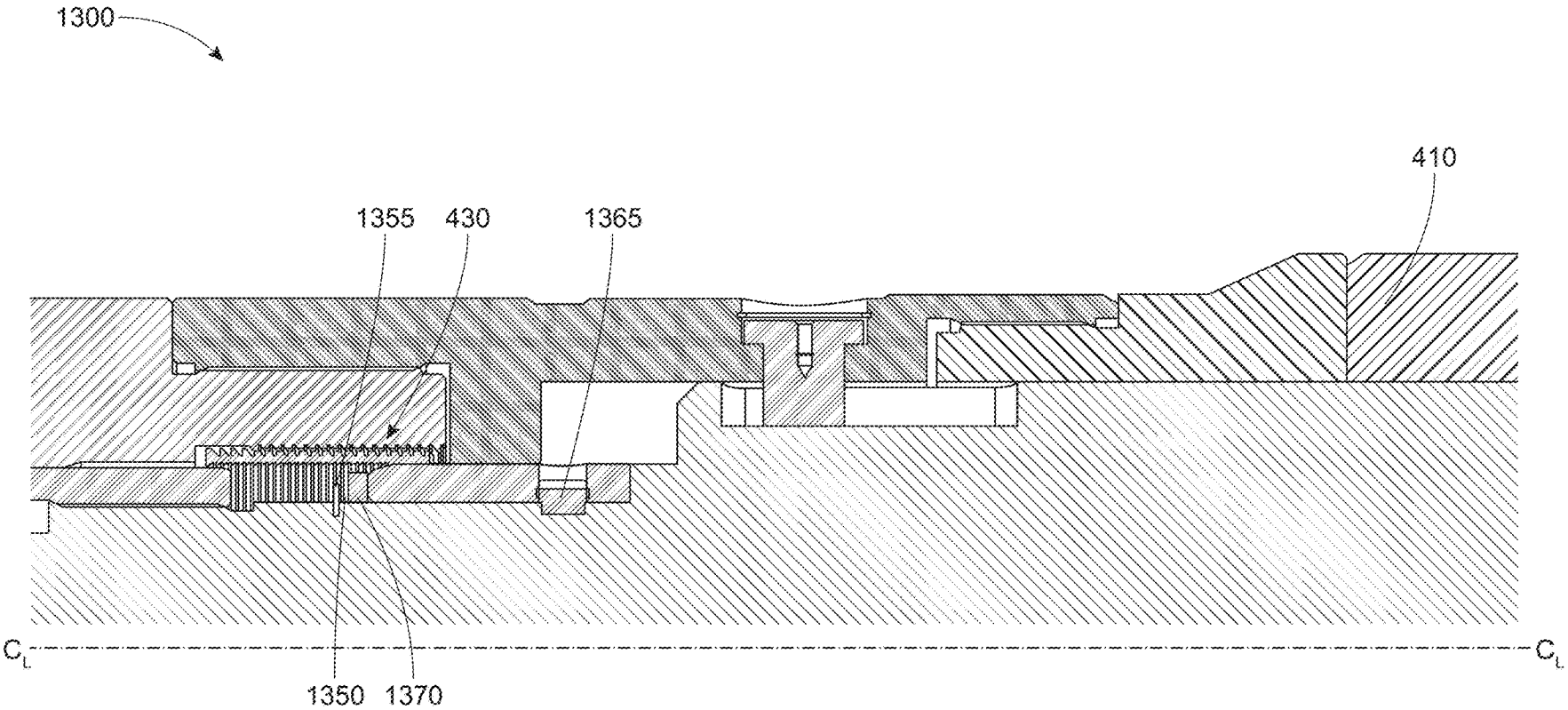

Turning to FIGS. 13A and 13B, illustrated are cross-sectional views of an anchoring subassembly 1300 designed, manufactured and operated according to an alternative embodiment of the disclosure. The anchoring subassembly 1300 is similar in many respects to the anchoring subassembly 400 illustrated above in FIGS. 4A and 4B. Accordingly, like reference numbers have been used to indicate similar, if not identical, features. The anchoring subassembly 1300 differs, for the most part, from the anchoring subassembly 400, in that the primary holding shear features 1365 of the anchoring subassembly 1300 is downhole of its secondary holding shear features 1355, whereas the primary holding shear features 465 of the anchoring subassembly 400 is uphole of its secondary holding shear features 455. Thus, the one or more downhole primary holding shear features 1365 have a lower shear strength than the one or more uphole secondary holding shear features 1355. Further to the embodiment of FIGS. 13A and 13B, a replaceable spacer feature 1370 can be added to a relaxation gap 1350 to adjust a relaxation space for relaxing the isolation element 410.

Turning to FIGS. 14A through 17B, illustrated is one embodiment for deploying, setting, relaxing and retrieving an anchoring subassembly 1400 designed, and manufactured according to one or more embodiments of the disclosure. The anchoring subassembly 1400 is similar in many respects to the anchoring subassembly 1300 described and illustrated with respect to FIGS. 13A and 13B. Accordingly, like reference numbers have been used to illustrate similar features. The anchoring subassembly 1400 includes an isolation element 410, one or more setting shear features 420, a ratch latch body 430 (e.g., including shear sub 430*a*, body lock ring 430*b*, and slip ring 430*c*), a relaxation gap 1350, one or more secondary holding shear features 1355, and one or more primary holding shear features 1365.

Figure 14A:
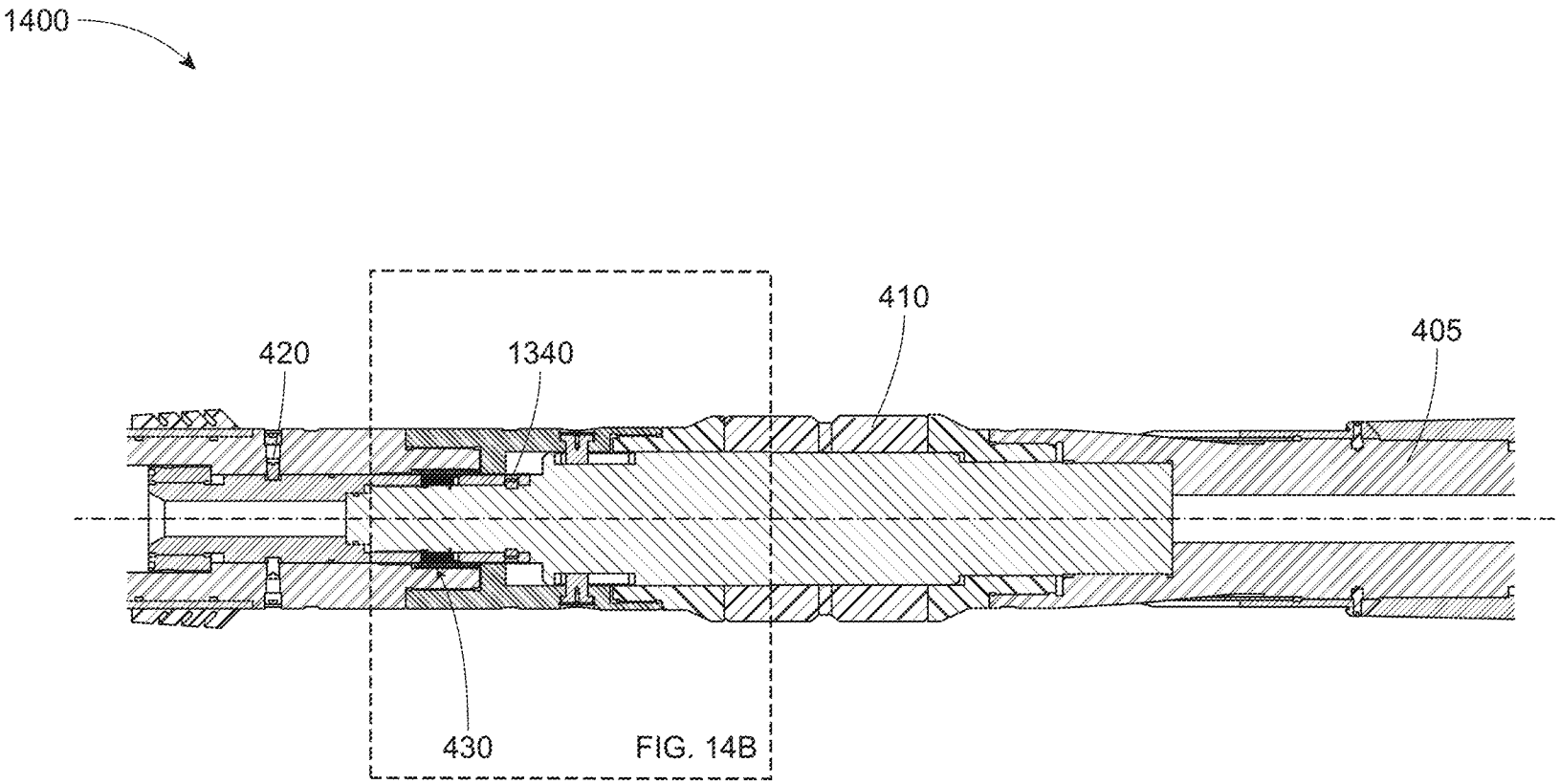
FIGS. 14A through 17B illustrated one embodiment for deploying, setting, relaxing and retrieving an anchoring subassembly designed, and manufactured according to one or more embodiments of the disclosure.
Figure 14B:
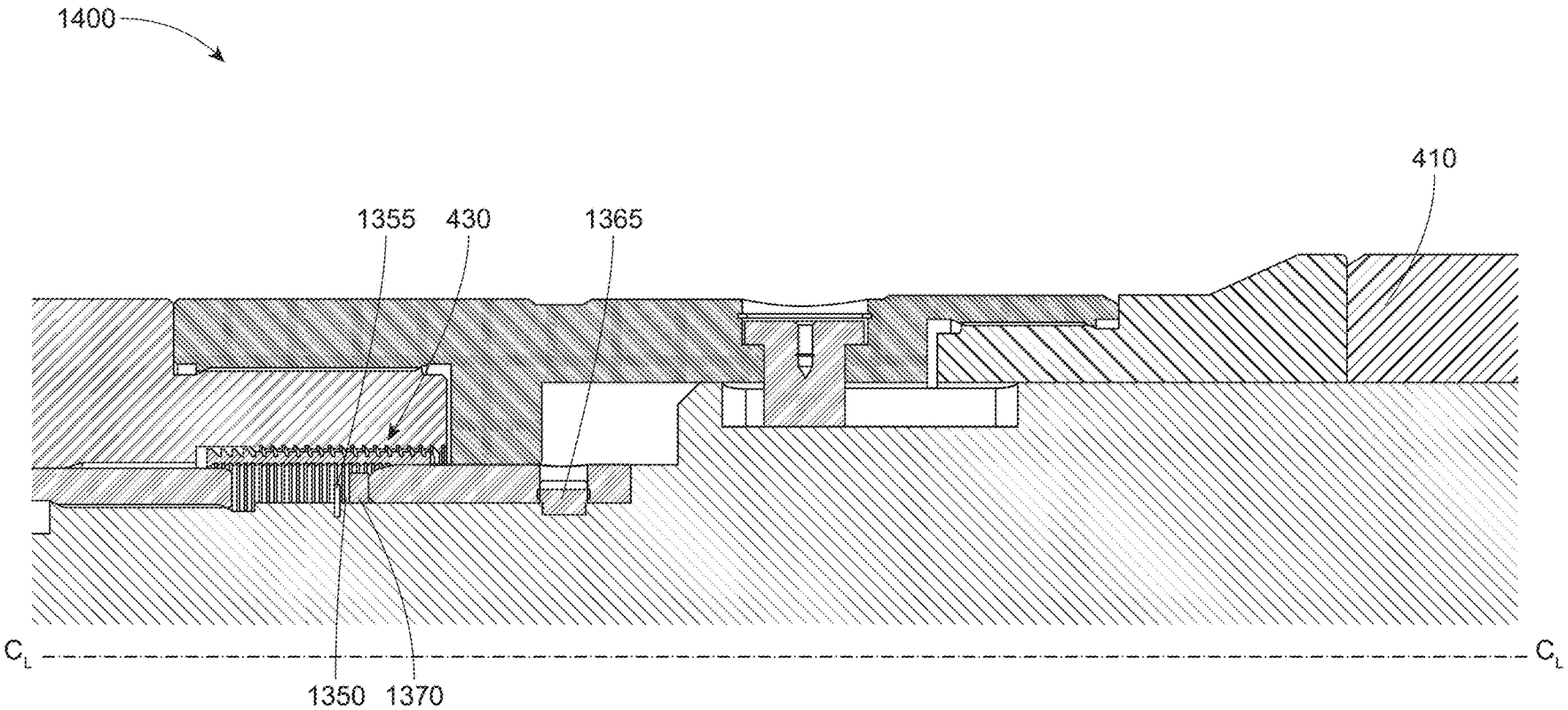
Figure 15A:
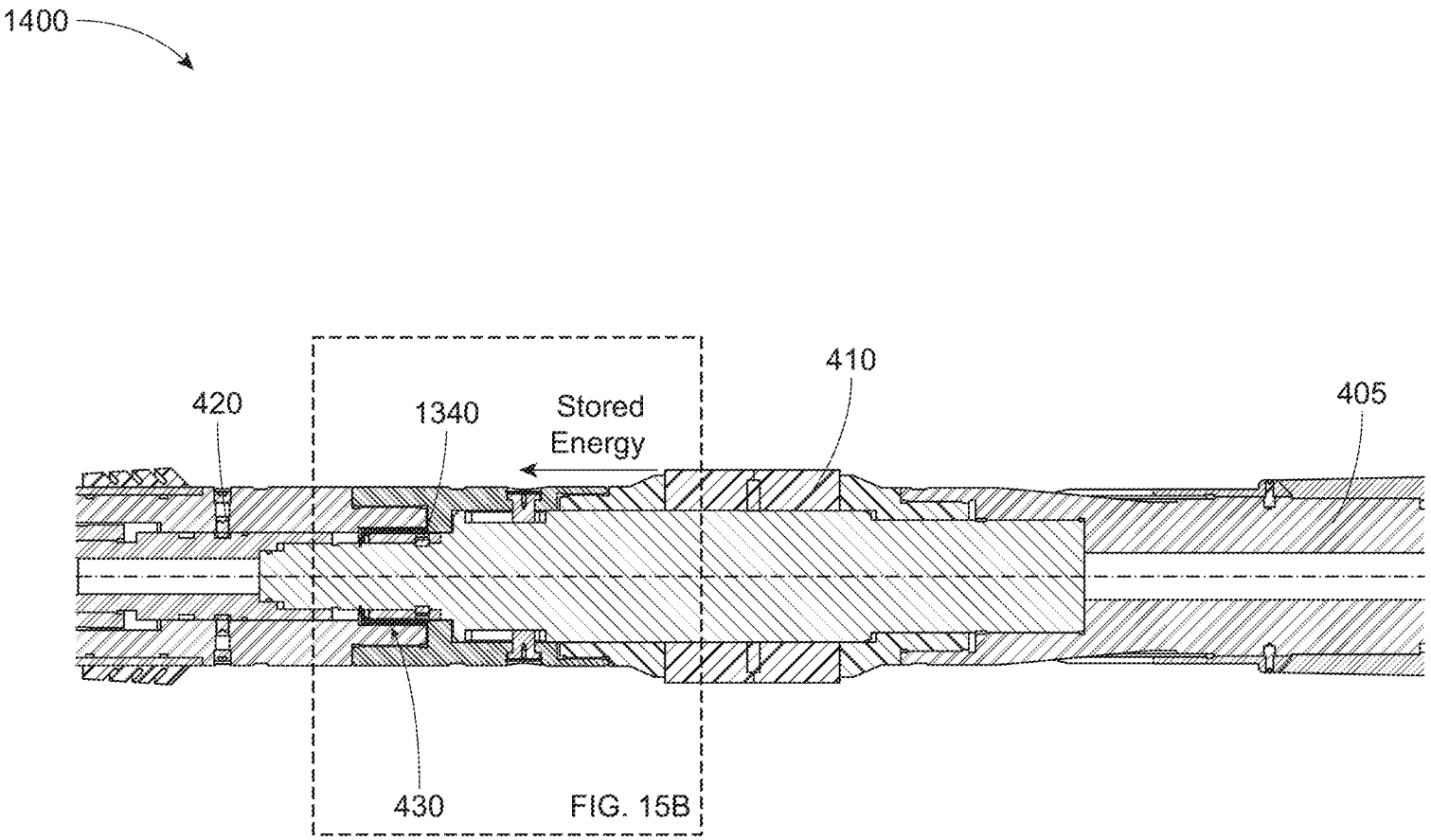
Figure 15B:
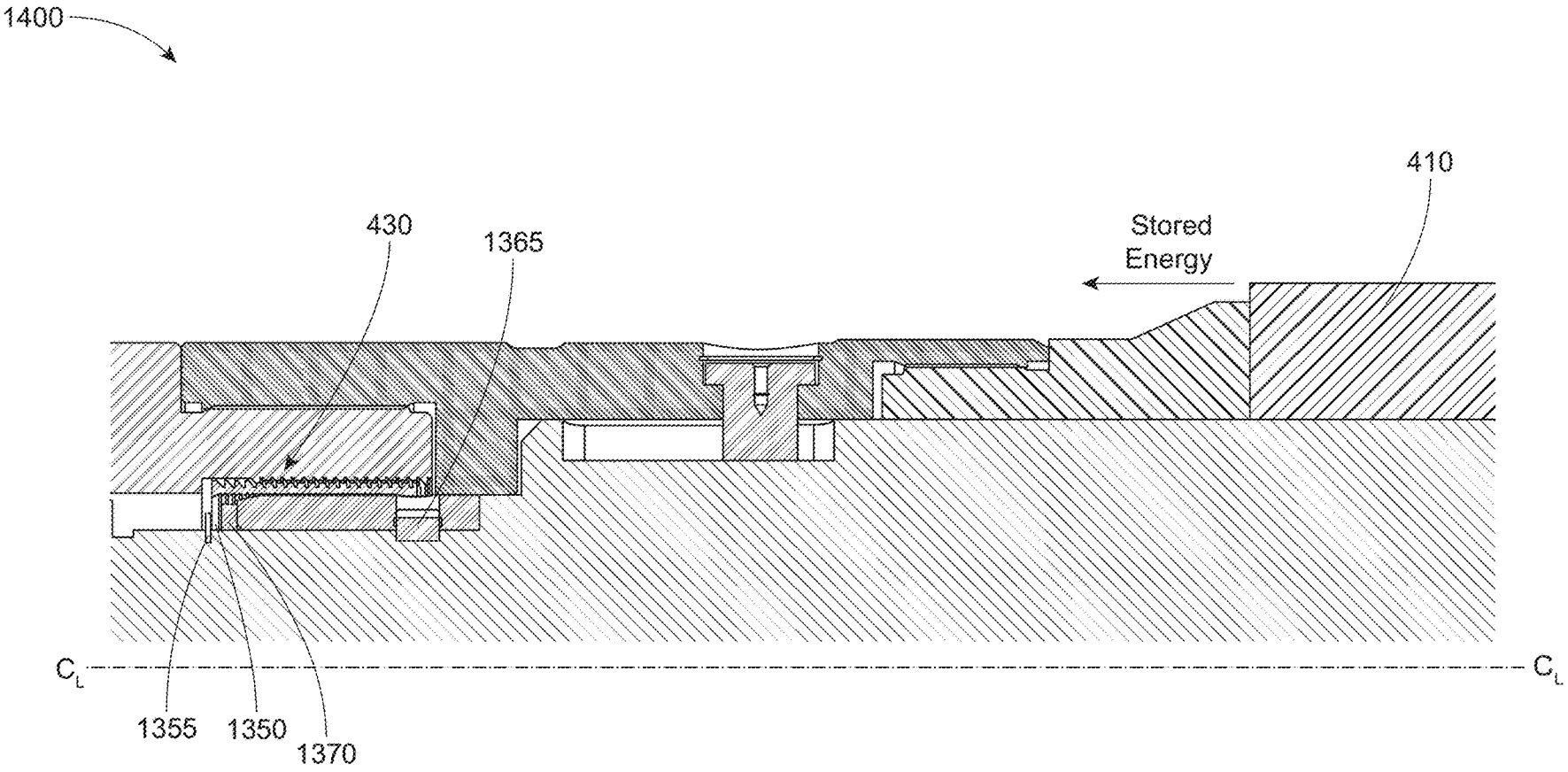

The anchoring subassembly 1400 is run in hole, for example in the state shown in FIGS. 14A and 14B. With the anchoring subassembly 1400 run in hole to the proper depth, the latching feature of the latching element section (not shown) may be set. With the latching feature set, the anchoring subassembly 1400 may be pushed to shear the one or more setting shear features 420, thereby setting the isolation element 410 (e.g., as shown in FIGS. 15A and 15B). In the illustrated embodiment, the one or more primary holding shear features 1365 hold the isolation element 410 at the setting position (e.g., again as shown in FIGS. 15A and 15B).

Figure 16A:
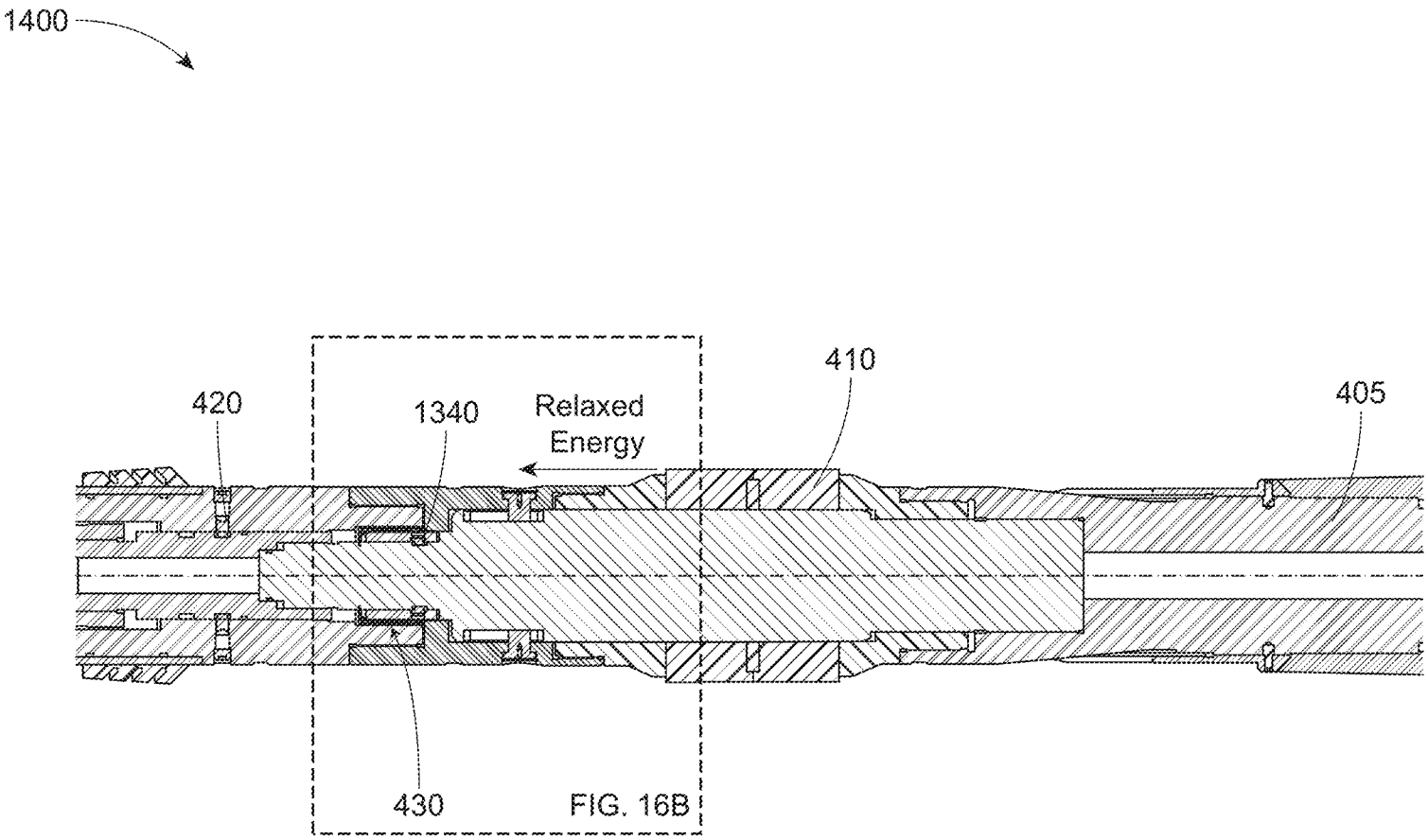
Figure 16B:
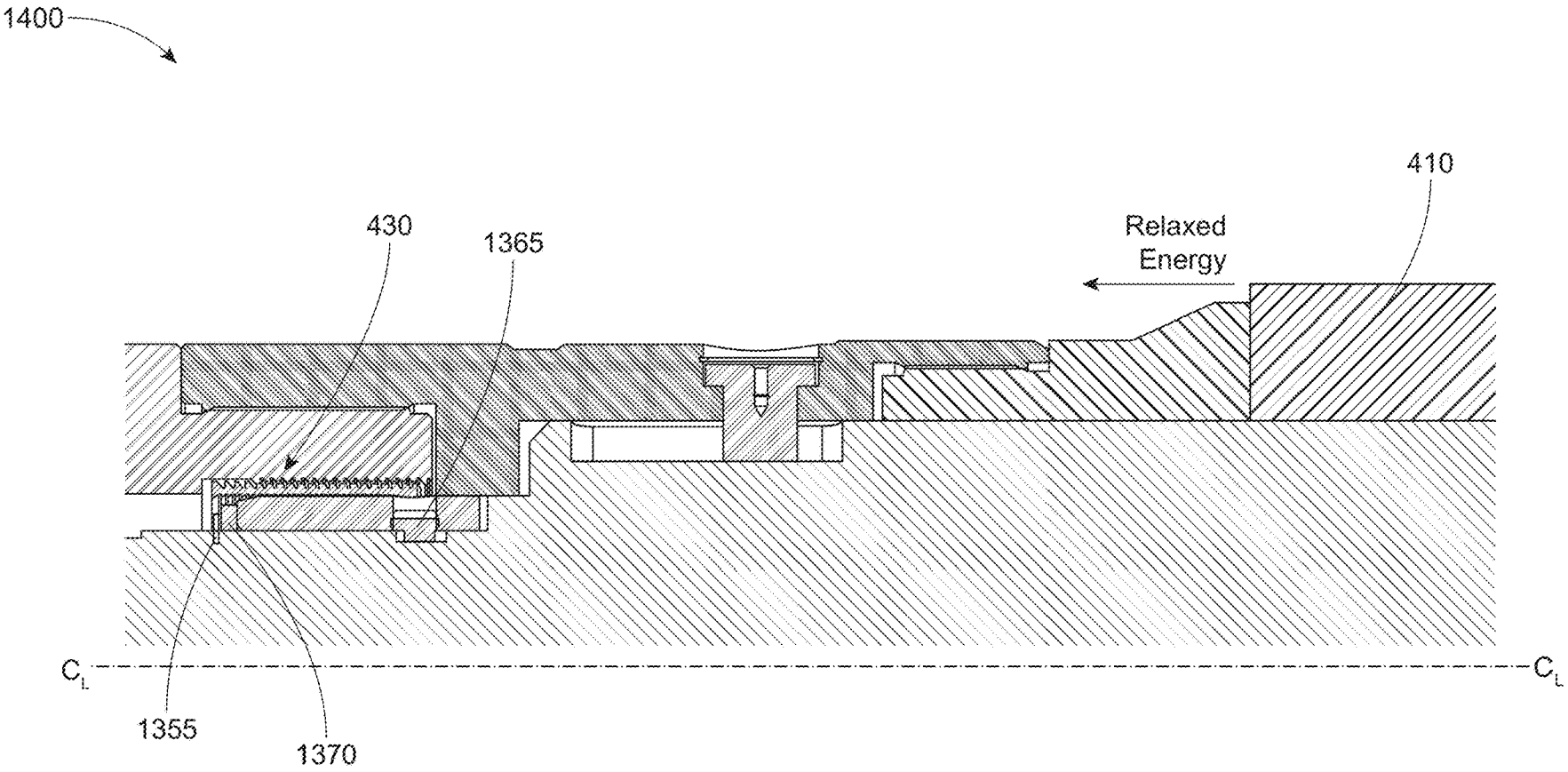

In the case that the stored energy in the isolation element 410 is higher than the shear value of the one or more primary holding shear features 1365, the stored energy transmits from the isolation element 410 through the set ratch latch body 430 to the one or more primary holding shear features 1365, thereby shearing the one or more primary holding shear features 1365. The shearing of the one or more primary holding shear features 1365, allows the one or more secondary shear features 1355 to close the relaxation gap 1350, and thereby relax the isolation element 410 to the relaxed radially expanded state. For example, as the one or more primary holding shear features 1365 shear, the isolation element 410 starts to slide back until the relaxation gap 1350 between the one or more secondary holding shear features 1355 and internal mandrel closes, thereby relaxing the isolation element 410 to the relaxed radially expanded state (e.g., as shown in FIGS. 16A and 16B). After self-relaxing the isolation element 410, the one or more secondary holding shear features 1355 now hold the isolation element 410 in a new (e.g., relaxed) state. In the illustrated embodiment, the spacer feature 1370 may be used to help set the relaxation spacing (e.g., to adjust an amount of movement of the isolation element upon the primary holding feature shearing).

Figure 17A:
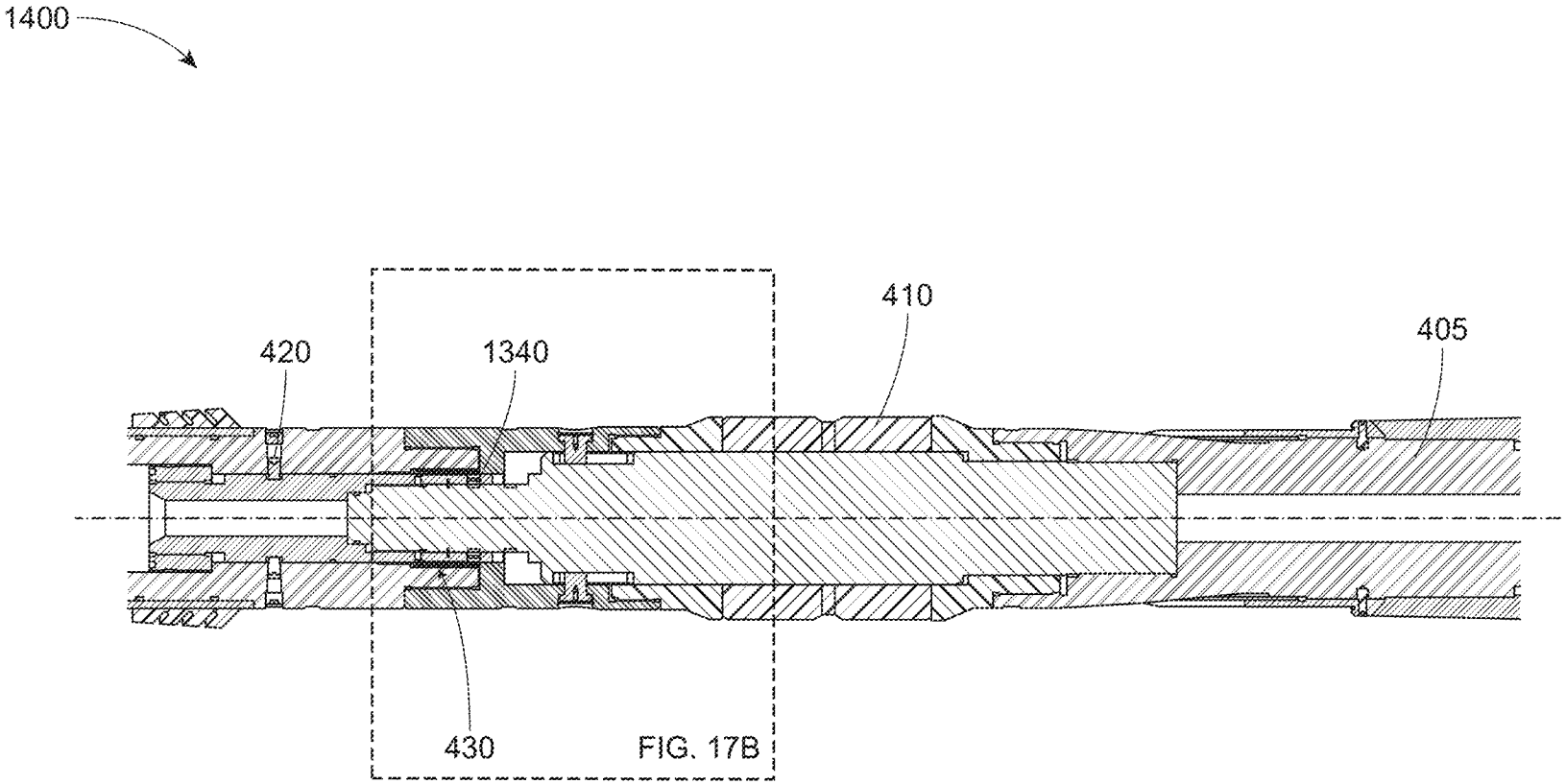
Figure 17B:
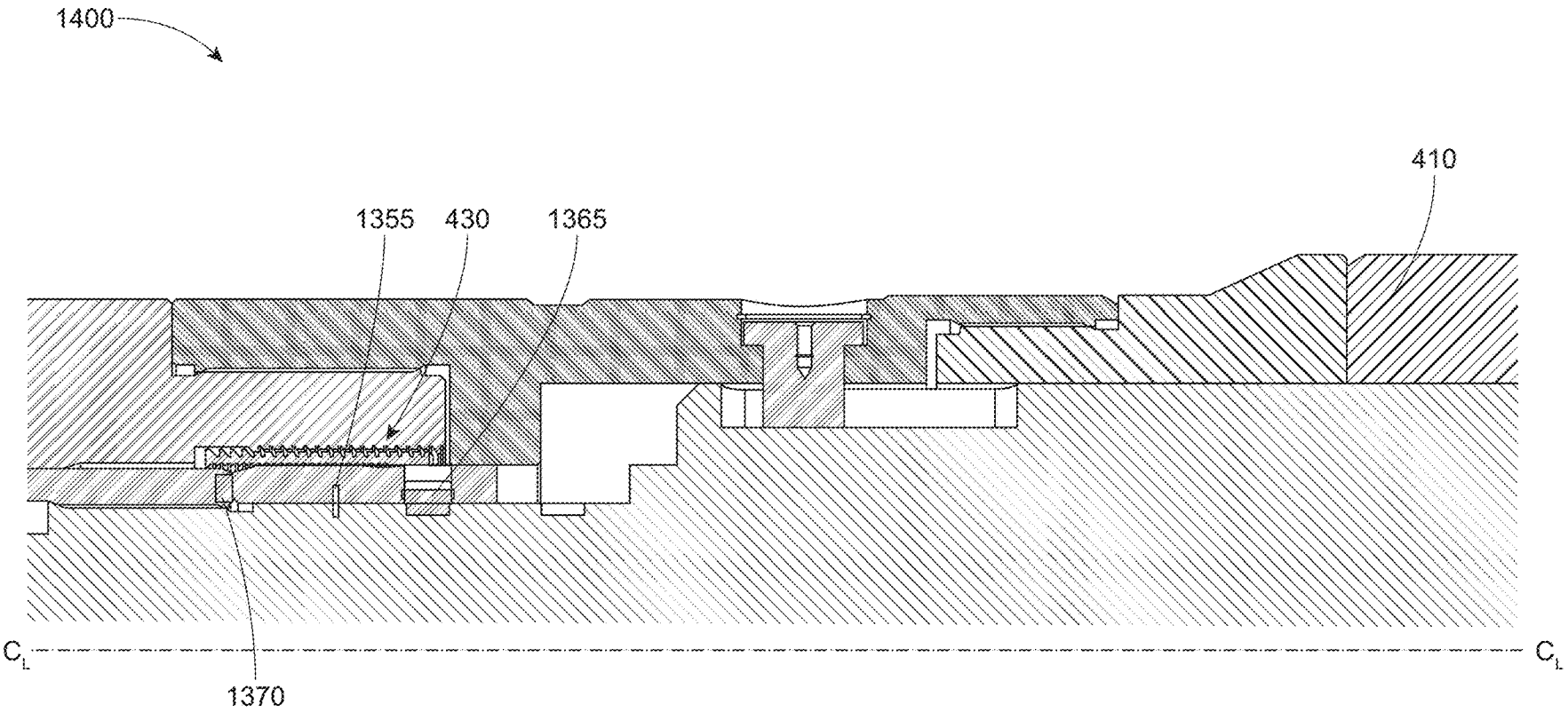

When it is time to unset the isolation element 410, and thus pull the anchoring subassembly 1400 uphole, the whipstock assembly may be pulled uphole to shear the one or more secondary holding shear features 1355. In doing so, the isolation element 410 returns to its original radially retracted state. At this stage, the anchoring subassembly 1400 is ready to be pulled uphole without worrying about swabbing (e.g., as shown in FIGS. 17A and 17B). As discussed above, a washover assembly could alternatively be used to remove the whipstock assembly.

Aspects disclosed herein include:

A. An anchoring subassembly, the anchoring subassembly including: 1) a mandrel; 2) an isolation element positioned about the mandrel, the isolation element configured to move between a radially retracted state, a fully radially expanded state, and a relaxed radially expanded state; 3) a ratch latch body coupled to the isolation element, the ratch latch body configured to hold the isolation element in the fully radially expanded state; and 4) a relief feature coupled to the ratch latch body, the relief feature configured to shear to release stored energy in the isolation element and thereby allow the isolation element to move from the fully radially expanded state to the relaxed radially expanded state.

B. A well system, the well system including: 1) a main wellbore located in a subterranean formation; 2) a lateral wellbore extending from the main wellbore; and 3) a whipstock assembly including an anchoring subassembly positioned proximate an intersection between the main wellbore and the lateral wellbore, the anchoring subassembly including: a) a mandrel; b) an isolation element positioned about the mandrel, the isolation element configured to move between a radially retracted state, a fully radially expanded state, and a relaxed radially expanded state; c) a ratch latch body coupled to the isolation element, the ratch latch body configured to hold the isolation element in the fully radially expanded state; and d) a relief feature coupled to the ratch latch body, the relief feature configured to shear to release stored energy in the isolation element and thereby allow the isolation element to move from the fully radially expanded state to the relaxed radially expanded state.

C. A method, the method including: 1) positioning a whipstock assembly including an anchoring subassembly proximate an intersection between a main wellbore and a lateral wellbore, the anchoring subassembly including: a) a mandrel; b) an isolation element positioned about the mandrel, the isolation element configured to move between a radially retracted state, a fully radially expanded state, and a relaxed radially expanded state; c) a ratch latch body coupled to the isolation element, the ratch latch body configured to hold the isolation element in the fully radially expanded state; and d) a relief feature coupled to the ratch latch body, the relief feature configured to shear to release stored energy in the isolation element and thereby allow the isolation element to move from the fully radially expanded state to the relaxed radially expanded state, wherein the isolation element is in the fully radially expanded state.

Aspects A, B and C may have one or more of the following additional elements in combination: Element 1: wherein the relief feature is a primary holding shear feature coupled to the ratch latch body, and further including a secondary holding shear feature coupled to the ratch latch body, the secondary holding shear feature configured to hold the isolation element in a relaxed radially expanded state upon the primary holding shear feature shearing. Element 2: wherein the primary holding shear feature has a primary shear strength less than or equal to a secondary shear strength of the secondary holding shear feature. Element 3: wherein the primary holding shear feature has a primary shear strength less than a secondary shear strength of the secondary holding shear feature. Element 4: wherein the primary holding shear feature is located uphole of the secondary holding shear feature. Element 5: wherein the secondary holding shear feature is located in a gapped profile in the mandrel, the secondary holding shear feature including a first relaxation gap located on a first side of the secondary holding shear feature when the isolation element is in the fully radially expanded state and a second relaxed gap located on a second side of the secondary holding shear feature when the isolation element is in the relaxed radially expanded state. Element 6: wherein the first relaxation gap is located uphole of the second relaxed gap. Element 7: wherein the primary holding shear feature is located downhole of the secondary holding shear feature. Element 8: further including a relaxation gap located between the secondary holding shear feature and the ratch latch body when the isolation element is in the fully radially expanded state, the relaxation gap configured to close upon the primary holding shear feature shearing, thereby allowing the isolation element to move to the relaxed radially expanded state. Element 9: further including a replaceable spacer feature located within the relaxation gap, the replaceable spacer feature configured to adjust an amount of movement of the isolation element upon the primary holding feature shearing. Element 10: wherein the whipstock assembly further includes a whipstock element section position uphole of the sealing element while the isolation element is in the fully radially expanded state or the relaxed radially expanded state. Element 11: further including shearing the relief feature coupled to the ratch latch body while the isolation element is in the fully radially expanded state, the shearing allowing the isolation element to move to the relaxed radially expanded state. Element 12: further including applying pressure to the whipstock assembly to move the isolation element from the relaxed radially expanded state to the radially retracted state, and then pulling the whipstock assembly uphole. Element 13: further including washing over the isolation element in the relaxed radially expanded state, and then pulling the whipstock assembly uphole.

Those skilled in the art to which this application relates will appreciate that other and further additions, deletions, substitutions and modifications may be made to the described embodiments.

What is claimed is:

1. An anchoring subassembly, comprising:

a mandrel;

an isolation element positioned about the mandrel, the isolation element configured to move between a radially retracted state, a fully radially expanded state, and a relaxed radially expanded state;

a ratch latch body coupled to the isolation element, the ratch latch body configured to hold the isolation element in the fully radially expanded state; and a relief feature coupled to the ratch latch body, the relief feature configured to shear to release stored energy in the isolation element and thereby allow the isolation element to move from the fully radially expanded state to the relaxed radially expanded state, wherein the relief feature is a primary holding shear feature coupled to the ratch latch body, and further including a secondary holding shear feature coupled to the ratch latch body, the secondary holding shear feature configured to hold the isolation element in a relaxed radially expanded state upon the primary holding shear feature shearing.

2. The anchoring subassembly as recited in claim 1, wherein the primary holding shear feature has a primary shear strength less than or equal to a secondary shear strength of the secondary holding shear feature.

3. The anchoring subassembly as recited in claim 2, wherein the primary holding shear feature has a primary shear strength less than a secondary shear strength of the secondary holding shear feature.

4. The anchoring subassembly as recited in claim 2, wherein the primary holding shear feature is located uphole of the secondary holding shear feature.

5. The anchoring subassembly as recited in 4, wherein the secondary holding shear feature is located in a gapped profile in the mandrel, the secondary holding shear feature including a first relaxation gap located on a first side of the secondary holding shear feature when the isolation element is in the fully radially expanded state and a second relaxed gap located on a second side of the secondary holding shear feature when the isolation element is in the relaxed radially expanded state.

6. The anchoring subassembly as recited in claim 5, wherein the first relaxation gap is located uphole of the second relaxed gap.

7. The anchoring subassembly as recited in claim 2, wherein the primary holding shear feature is located downhole of the secondary holding shear feature.

8. The anchoring subassembly as recited in claim 7, further including a relaxation gap located between the secondary holding shear feature and the ratch latch body when the isolation element is in the fully radially expanded state, the relaxation gap configured to close upon the primary holding shear feature shearing, thereby allowing the isolation element to move to the relaxed radially expanded state.

9. The anchoring subassembly as recited in claim 8, further including a replaceable spacer feature located within the relaxation gap, the replaceable spacer feature configured to adjust an amount of movement of the isolation element upon the primary holding feature shearing.

10. A well system, comprising:

a main wellbore located in a subterranean formation;

a lateral wellbore extending from the main wellbore; and a whipstock assembly including an anchoring subassembly positioned proximate an intersection between the main wellbore and the lateral wellbore, the anchoring subassembly including:

a mandrel;

an isolation element positioned about the mandrel, the isolation element configured to move between a radially retracted state, a fully radially expanded state, and a relaxed radially expanded state;

a ratch latch body coupled to the isolation element, the ratch latch body configured to hold the isolation element in the fully radially expanded state; and a relief feature coupled to the ratch latch body, the relief feature configured to shear to release stored energy in the isolation element and thereby allow the isolation element to move from the fully radially expanded state to the relaxed radially expanded state, wherein the relief feature is a primary holding shear feature coupled to the ratch latch body, and further including a secondary holding shear feature coupled to the ratch latch body, the secondary holding shear feature configured to hold the isolation element in a relaxed radially expanded state upon the primary holding shear feature shearing.

11. The well system as recited in claim 10, wherein the primary holding shear feature has a primary shear strength less than or equal to a secondary shear strength of the secondary holding shear feature.

12. The well system as recited in claim 11, wherein the primary holding shear feature has a primary shear strength less than a secondary shear strength of the secondary holding shear feature.

13. The well system as recited in claim 11, wherein the primary holding shear feature is located uphole of the secondary holding shear feature.

14. The well system as recited in 13, wherein the secondary holding shear feature is located in a gapped profile in the mandrel, the secondary holding shear feature including a first relaxation gap located on a first side of the secondary holding shear feature when the isolation element is in the fully radially expanded state and a second relaxed gap located on a second side of the secondary holding shear feature when the isolation element is in the relaxed radially expanded state.

15. The well system as recited in claim 14, wherein the first relaxation gap is located uphole of the second relaxed gap.

16. The well system as recited in claim 11, wherein the primary holding shear feature is located downhole of the secondary holding shear feature.

17. The well system as recited in claim 16, further including a relaxation gap located between the secondary holding shear feature and the ratch latch body when the isolation element is in the fully radially expanded state, the relaxation gap configured to close upon the primary holding shear feature shearing, thereby allowing the isolation element to move to the relaxed radially expanded state.

18. The well system as recited in claim 17, further including a replaceable spacer feature located within the relaxation gap, the replaceable spacer feature configured to adjust an amount of movement of the isolation element upon the primary holding feature shearing.

19. The well system as recited in claim 10, wherein the whipstock assembly further includes a whipstock element section position uphole of the sealing element while the isolation element is in the fully radially expanded state or the relaxed radially expanded state.

20. A method, comprising:

positioning a whipstock assembly including an anchoring subassembly proximate an intersection between a main wellbore and a lateral wellbore, the anchoring subassembly including:

a mandrel;

an isolation element positioned about the mandrel, the isolation element configured to move between a radially retracted state, a fully radially expanded state, and a relaxed radially expanded state;

a ratch latch body coupled to the isolation element, the ratch latch body configured to hold the isolation element in the fully radially expanded state; and a relief feature coupled to the ratch latch body, the relief feature configured to shear to release stored energy in the isolation element and thereby allow the isolation element to move from the fully radially expanded state to the relaxed radially expanded state, wherein the isolation element is in the fully radially expanded state, wherein the relief feature is a primary holding shear feature coupled to the ratch latch body, and further including a secondary holding shear feature coupled to the ratch latch body, the secondary holding shear feature configured to hold the isolation element in a relaxed radially expanded state upon the primary holding shear feature shearing.

21. The method as recited in claim 20, further including shearing the relief feature coupled to the ratch latch body while the isolation element is in the fully radially expanded state, the shearing allowing the isolation element to move to the relaxed radially expanded state.

22. The method as recited in claim 21, further including applying pressure to the whipstock assembly to move the isolation element from the relaxed radially expanded state to the radially retracted state, and then pulling the whipstock assembly uphole.

23. The method as recited in claim 21, further including washing over the isolation element in the relaxed radially expanded state, and then pulling the whipstock assembly uphole.

24. The method as recited in claim 20, wherein the primary holding shear feature has a primary shear strength less than or equal to a secondary shear strength of the secondary holding shear feature.

25. The method as recited in claim 24, wherein the primary holding shear feature has a primary shear strength less than a secondary shear strength of the secondary holding shear feature.

26. The method as recited in claim 24, wherein the primary holding shear feature is located uphole of the secondary holding shear feature.

27. The method as recited in claim 26, wherein the secondary holding shear feature is located in a gapped profile in the mandrel, the secondary holding shear feature including a first relaxation gap located on a first side of the secondary holding shear feature when the isolation element is in the fully radially expanded state and a second relaxed gap located on a second side of the secondary holding shear feature when the isolation element is in the relaxed radially expanded state.

28. The method as recited in claim 27, wherein the first relaxation gap is located uphole of the second relaxed gap.

29. The well system as recited in claim 24, wherein the primary holding shear feature is located downhole of the secondary holding shear feature.

30. The method as recited in claim 29, further including a relaxation gap located between the secondary holding shear feature and the ratch latch body when the isolation element is in the fully radially expanded state, the relaxation gap configured to close upon the primary holding shear feature shearing, thereby allowing the isolation element to move to the relaxed radially expanded state.

31. The method as recited in claim 30, further including a replaceable spacer feature located within the relaxation gap, the replaceable spacer feature configured to adjust an amount of movement of the isolation element upon the primary holding feature shearing.

* * * * *